US007042319B2

(12) United States Patent
Ishiwata et al.

(10) Patent No.: US 7,042,319 B2
(45) Date of Patent: May 9, 2006

(54) THIN FILM ELECTROMAGNET AND SWITCHING DEVICE COMPRISING IT

(75) Inventors: Nobuyuki Ishiwata, Tokyo (JP); Hiroaki Honjo, Tokyo (JP); Tamaki Toba, Tokyo (JP); Shinsaku Saito, Tokyo (JP); Keishi Ohashi, Tokyo (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/486,687

(22) PCT Filed: Aug. 15, 2002

(86) PCT No.: PCT/JP02/08292

§ 371 (c)(1),
(2), (4) Date: Sep. 28, 2004

(87) PCT Pub. No.: WO03/017294

PCT Pub. Date: Feb. 27, 2003

(65) Prior Publication Data

US 2005/0047010 A1 Mar. 3, 2005

(30) Foreign Application Priority Data

Aug. 16, 2001 (JP) ..... 2001-247239

(51) Int. Cl.
*H01H 51/22* (2006.01)

(52) U.S. Cl. ..... 335/78; 335/85; 335/296; 336/200; 336/232

(58) Field of Classification Search ..... 335/296–299, 335/78–86; 200/181, 600; 336/200, 232

See application file for complete search history.

(56) References Cited

U.S. PATENT DOCUMENTS

| | | | |
|---|---|---|---|
| 5,018,256 | A | 5/1991 | Hornbeck |
| 5,083,857 | A | 1/1992 | Hornbeck |
| 5,099,353 | A | 3/1992 | Hornbeck |
| 5,216,537 | A | 6/1993 | Hornbeck |
| 5,331,454 | A | 7/1994 | Hornbeck |
| 5,535,047 | A | 7/1996 | Hornbeck |
| 5,578,976 | A | 11/1996 | Yao |
| 5,600,383 | A | 2/1997 | Hornbeck |
| 5,617,242 | A | 4/1997 | Weaver |
| 5,638,946 | A | 6/1997 | Zavracky |
| 5,717,513 | A | 2/1998 | Weaver |
| 5,768,007 | A | 6/1998 | Knipe et al. |
| 5,771,116 | A | 6/1998 | Miller et al. |
| 5,939,785 | A | 8/1999 | Klonis et al. |
| 5,964,242 | A | 10/1999 | Slocum |
| 6,046,659 | A | 4/2000 | Loo et al. |
| 6,057,520 | A | 5/2000 | Goodwin-Johansson |
| 6,069,540 | A | 5/2000 | Berenz et al. |
| 6,100,477 | A | 8/2000 | Randall et al. |
| 6,123,985 | A | 9/2000 | Robinson et al. |

(Continued)

FOREIGN PATENT DOCUMENTS

EP 0 685 864 A1 12/1995

(Continued)

*Primary Examiner*—Ramon M. Barrera
(74) *Attorney, Agent, or Firm*—Posz Law Group, PLC

(57) ABSTRACT

The present invention provided a thin-film electromagnet including a magnetic yoke and a thin-film coil, characterized in that the magnetic yoke includes a first magnetic yoke and a second magnetic yoke making contact with the first magnetic yoke, the first magnetic yoke is located at a center of a winding of the thin-film coil, and the second magnetic yoke is arranged above or below the thin-film coil such that the second magnetic yoke faces the thin-film coil, and overlaps at least a part of the thin-film coil.

31 Claims, 21 Drawing Sheets

U.S. PATENT DOCUMENTS

| | | | | |
|---|---|---|---|---|
| 6,124,650 | A | 9/2000 | Bishop et al. | |
| 6,201,629 | B1 | 3/2001 | McClelland et al. | |
| 2001/0020886 | A1* | 9/2001 | Matsumoto et al. | 336/200 |
| 2001/0054946 | A1* | 12/2001 | Inoue et al. | 336/200 |

FOREIGN PATENT DOCUMENTS

| | | |
|---|---|---|
| JP | A-11-154447 | 6/1999 |
| JP | A-2000-10028 | 1/2000 |

* cited by examiner

THIN FILM ELECTROMAGNET AND SWITCHING DEVICE COMPRISING IT

BACKGROUND OF THE INVENTION

1. Field of the Invention

The invention relates to a thin-film electromagnet and a switching device including the same, and more particularly to a switch for turning on or off a current signal covering a dc current to an ac current having a frequency in the range of zero to a GHz or greater, and a micro electronics mechanical system (MEMS) switch applicable to an optical device such as a semiconductor laser which is capable of varying a wavelength of laser beams, an optical filter and an optical switch.

2. Description of the Related Art

Many conventional MEMS switches include a thin-film electromagnet for turning on or off a switch by driving a movable portion by means of electrostatic force.

For instance, such a MEMS switch is suggested in U.S. Pat. Nos. 5,578,976, 6,069,540, 6,100,477, 5,638,946, 5,964,242, 6,046,659, 6,057,520, 6,123,985, 5,600,383 and 5,535,047.

A conventional MEMS switch such as that described in U.S. Pat. No. 5,578,976 will now be discussed. FIG. 18A is a plan view of a MEMS switch suggested in U.S. Pat. No. 5,578,976, and FIG. 18B is a cross-sectional view taken along the line 18B—18B in FIG. 18A.

The MEMS switch illustrated in FIGS. 18A and 18B includes a substrate 101, a support 103 formed on the substrate 101, and a cantilever arm 104 swingable about the support 103.

On the substrate 101 are formed a lower electrode 102 composed of gold and signal lines 106 composed of gold.

The cantilever arm 104 comprised of a silicon oxide film is fixed at its fixed end to the support 103, and has a free end facing the signal lines 106. That is, the cantilever arm 104 extends to a point located above the signal lines 106 beyond the lower electrode 102 from the support 103, and faces the lower electrode 102 and the signal lines 106 with a spatial gap therebetween.

On an upper surface of the cantilever 104 extends an upper electrode 105 composed of aluminum from the support 103 to a location facing the lower electrode 102. On a lower surface of the cantilever 104 is formed a contact electrode 107 composed of gold such that the contact electrode 107 faces the signal lines 106.

The MEMS switch having such a structure as mentioned above operates as follows.

Applying a voltage across the upper electrode 105 and the lower electrode 102, attractive force caused by electrostatic force acts on the upper electrode 105 towards the substrate 101 (in a direction indicated with an arrow 108). As a result, the cantilever 104 deforms at its free end towards the substrate 101, and thus, the contact electrode 107 makes contact with facing ends of the signal lines 106.

In non-operation condition, since the gap separates the contact electrode 107 and the signal lines 106 from each other, the signal lines 106 are electrically insulated from each other. Accordingly, when a voltage is not applied across the upper electrode 105 and the lower electrode 102, a current does not run through the signal lines 106.

When a voltage is applied across the upper electrode 105 and the lower electrode 102 to thereby cause the contact electrode 107 to make contact with the signal lines 106, the signal lines 106 are electrically connected to each other through the contact electrode 107, resulting in that a current runs through the signal lines 106.

As explained above, it is possible to control the on/off status of a current or signal running through the signal lines 106, by applying a voltage across the upper electrode 105 and the lower electrode 102.

However, the conventional MEMS switch making use of electrostatic force, illustrated in FIGS. 18A and 18B is accompanied with the following problems.

First, the attractive force is small, because it is derived from electrostatic force.

FIG. 21 is a graph showing the dependency of electrostatic force and electromagnetic force on a size.

As is obvious in view of FIG. 21, electrostatic force is smaller than electromagnetic force by one to three column(s) in a size in the range of tens of micrometers to hundreds of micrometers to which a MEMS switch is applied.

A relay switch to which the MEMS switch illustrated in FIGS. 18A and 18B is applied is said to be required to have a contact pressure of about $10^{-2}$ N in order to suppress contact resistance in an electrical contact and accomplish adequate electrical connection.

It is understood in view of FIG. 21 that if a distance between electrodes is 100 micrometers and a contact area is 10,000 square micrometers, there is obtained a force of about $10^{-5}$ N, even if a voltage of $3\times10^{6}$ V/cm is applied across the electrodes.

Second, a high voltage is maintained across the lower electrode 102 and the upper electrode 105 in order to keep the MEMS switch illustrated in FIGS. 18A and 18B on.

This means that electric power is always consumed. In addition, application of a high voltage across electrodes facing each other with a small gap therebetween creates problems such as destruction of a device caused by generation of surge current.

Third, even if a high contact pressure is not required unlike a relay switch, a digital micro-miller device (DMD) suggested, for instance, in U.S. Pat. Nos. 5,018,256, 5,083,857, 5,099,353 and 5,216,537 is accompanied with a problem that a pair of electrodes are absorbed to each other when they make contact with each other by electrostatic force, and thus, they cannot be separated from each other by electrostatic force with the result of inappropriate operation.

A solution to the problem unique to DMD is suggested, for instance, in U.S. Pat. Nos. 5,331,454, 5,535,047, 5,617,242, 5,717,513, 5,939,785, 5,768,007 and 5,771,116.

A digital micro-miller device (DMD) is a smallest device among MEMS devices, and has a movable portion having a size of a few micrometers. Hence, a digital micro-miller device can obtain relatively high electrostatic force. Accordingly, it is not always possible to apply the solution unique to a digital micro-miller device to a MEMS switch having a size of about 100 micrometers or greater.

Fourth, a device which operates in analogue manner, such as an optical switch including a MEMS mirror suggested in U.S. Pat. No. 6,201,629 or 6,123,985 can have just a limited controllably operational range.

Supposing two electrodes arranged to face in parallel with each other, if a distance between the two electrodes becomes smaller than two thirds of an initial distance, the two electrodes rapidly make contact with each other, resulting in inability of control in operation of the electrodes. This is a general principle which can be analytically obtained.

Hence, if a swingable angle of a MEMS mirror is made greater, a distance between the electrodes has to be made greater, resulting in that a device including the MEMS mirror has to operate in a range in which electrostatic force is small. In contrast, if a device is designed to include a MEMS switch having a small swingable angle, an optical switch which is often required to be arrayed in a large scale such as 1000×1000 or 4000×4000 has to have a large-sized switch. This is not practical.

As explained above, there are caused a lot of critical problems due to electrostatic force in a size of a MEMS switch in the range of a few micrometers to hundreds of micrometers.

One solution to these problems is to use electromagnetic force in place of electrostatic force.

As shown in FIG. 21, electromagnetic force is greater than electrostatic force by one to three column(s) in a size in the range of tens of micrometers to hundreds of micrometers to which a MEMS switch is applied. U.S. Pat. No. 6,124,650 describes a MEMS switch in which electromagnetic force is used. Such a MEMS switch is illustrated in FIG. 19.

On a substrate 201 are formed a plurality of current wires 203, and a cantilever arm 202 bridging over the current wires 203. A magnetic layer 204 is formed on the cantilever arm 202, and an electrical contact 206 is formed on the cantilever arm 202 at a distal end thereof. On another substrate 208 fixed relative to the substrate 201 are formed a magnetic layer 205 facing the magnetic layer 204, and an electrical contact 207 facing the electrical contact 206. The magnetic layer 204 is composed of soft magnetic substance, and the magnetic layer 205 is composed of hard magnetic substance.

The MEMS switch illustrated in FIG. 19 operates as follows.

The magnetic layer 204 is magnetized in a direction due to a magnetic field generated by a current running through the current wires 203. For instance, the magnetic layer 204 is magnetized to have N-polarity at its left end in FIG. 19, and S-polarity at its right end in FIG. 19.

Contrary to the magnetization of the magnetic layer 204, the magnetic layer 205 is magnetized in advance to have S-polarity at its left side and N-polarity at its right side. Thus, attractive force is generated between the right end of the magnetic layer 204 and the right end of the magnetic layer 205, and hence, the cantilever 202 is bent towards the substrate 208 located thereabove. As a result, the electrical contacts 206 and 207 make contact with each other to thereby turn a switch on. Even if a current running through the current wires 203 is shut off, since the magnetic layers 204 and 205 have remanent magnetism, the switch is kept on.

By making a current run through the current wires 203 in the opposite direction, remanent magnetism in the magnetic layer 204 is reduced as the current is gradually increased, and then, a force making the cantilever arm 202 return to its original position exceeds the attractive force generated between the magnetic layers 204 and 205. If the current running through the current wires 203 is shut off in such a condition, the electrical contacts 206 and 207 are separated from each other, and thus, the switch is turned off.

However, the MEMS switch illustrated in FIG. 19 has the following associated drawbacks.

First, when the magnetic layer 204 is magnetized by a magnetic field generated by the current running through the current wires 203, it would not be possible to sufficiently magnetize the magnetic layer 204, because the magnetic layer 204 has an intensive diamagnetic field.

This is because of dimensional limit caused by the arrangement in which the magnetic layer 204 is formed on the cantilever arm 202.

In order to weaken a diamagnetic field for sufficiently magnetizing the magnetic layer 204 by a magnetic field generated by a weak current, the magnetic layer 204 has to be formed lengthy in a direction of magnetization and thin.

However, if the magnetic layer 204 is so formed, magnetic flux which the magnetic layer 204 originally generates is reduced. As a result, the attractive force between the magnetic layers 204 and 205 is reduced.

In contrast, if the magnetic layer 204 is formed wider and thicker, a diamagnetic field would be greater, and hence, it would be necessary to make a current run through the current wires in a larger amount in order to magnetize the magnetic layer 204, resulting in an increase in power consumption.

As explained above, the MEMS switch illustrated in FIG. 19 is accompanied with the antinomic problem.

Second, the MEMS switch illustrated in FIG. 19 is difficult to fabricate.

This is because the cantilever arm 202 acting as a movable portion is designed to be arranged in a space formed between the fixed substrates 201 and 208.

As illustrated in FIG. 19, in the process of fabrication of the cantilever arm 202, there is first formed a sacrificial layer which will be removed in a final step of the process, and then, the cantilever arm 202, the magnetic layer 204 and the electric contact 206 are formed on the sacrificial layer. Then, another sacrificial layer is formed on the cantilever arm 202, and then, the substrate 208 including the magnetic layer 205 and the electrical contact 207 is formed on the sacrificial layer. In a final step of the fabrication process, the two sacrificial layers formed on and below the cantilever arm 202 are removed by etching, for instance.

When the sacrificial layers are removed, there are caused two problems as follows.

The first problem is that surfaces of the cantilever arm 202 and the substrates 201 and 208 are contaminated, and etching residue and re-formed deposit are adhered to the surfaces, after the etching has been carried out. As a result, there are caused many troubles such as degradation of the electrical contacts 206 and 207, defective operation of the cantilever arm 202 as a movable portion, and adsorption of adhesive contaminants to the cantilever arm 202.

The second problem is that when the sacrificial layers are wet-etched or when the sacrificial layers are wet-washed after dry-etched, the cantilever arm 202 is adsorbed to the substrate 201 or 208 because of surface tension of an etchant or a washing solution, and thus, cannot be peeled off the substrate 201 or 208.

The above-mentioned two problems are caused by the arrangement that the cantilever arm 202 acting as a movable portion is located between the fixed substrates 201 and 208, and are frequently caused with the result of reduction in a fabrication yield and increase in fabrication costs.

As a solution to the above-mentioned problems, there is a process in which the substrate 208 including the magnetic layer 205 and the electrical contact 207 is fabricated separately from the substrate 201 including the cantilever arm 202 and the current wires 203, and the substrates are adhered to each other in a final step.

However, the process requires a doubled number of ceramic wafers which will make the substrates 201 and 208, resulting in an unavoidable increase in fabrication costs.

In addition, the arrangement of the cantilever arm 202 between the fixed substrates 201 and 208 makes it difficult to observe and inspect the cantilever arm 202. Hence, it would be difficult to check defects such as the above-mentioned adsorption, preventing analysis of a cause of the defects. This results in further reduction in a fabrication yield and further increase in fabrication costs.

U.S. Pat. No. 6,124,650 suggests such a MEMS switch as illustrated in FIG. 20.

In the MEMS switch, a plurality of current wires 303 is formed on a substrate 301, and a cantilever arm 302 bridges over the current wires. A magnetic layer 304 is formed on an upper surface of the cantilever arm 302, and an electrical contact 307 is formed on a lower surface of the cantilever arm 302 at a distal end.

A magnetic layer 305 is formed on the substrate 301, facing a part of the magnetic layer 304, and an electrical contact 306 is arranged in facing relation to the electrical contact 307. The magnetic layer 304 is composed of soft magnetic substance, and the magnetic layer 305 is composed of hard magnetic substance.

The MEMS switch illustrated in FIG. 20 solves the above-mentioned second problem, but cannot solve the above-mentioned first problem.

In view of the above-mentioned problems in conventional switching devices, it is an object of the present invention to provide a MEMS switch which is capable of accomplishing wide-range movement by virtue of attractive and repulsive forces, is suitable to an optical switch, a relay switch, a semiconductor laser irradiating laser beams having a variable wavelength, and an optical filter, and can be readily fabricated.

SUMMARY OF THE INVENTION

In order to achieve the above-mentioned object, the present invention provides a thin-film electromagnet including a magnetic yoke and a thin-film coil. The magnetic yoke includes a first magnetic yoke and a second magnetic yoke making contact with the first magnetic yoke. The first magnetic yoke is located at a center of a winding of the thin-film coil, and the second magnetic yoke is arranged above or below the thin-film coil such that the second magnetic yoke faces the thin-film coil, and overlaps at least a part of the thin-film coil.

It is preferable that the thin-film electromagnet has magnetic poles at a surface of the first magnetic yoke which surface is opposite to a surface at which the first and second magnetic yokes make contact with each other, and further at an outer surface of the second magnetic yoke.

The magnetic pole generated at the surface of the first magnetic yoke may be out of a center of the winding of the thin-film coil.

The thin-film electromagnet may further include a substrate, in which case, the first and second magnetic yokes may be arranged on the substrate.

The substrate may be designed to constitute the second magnetic yoke.

The thin-film electromagnet may further include an insulating layer formed on the first or second magnetic yoke, in which case, the thin-film coil may be formed on the insulating layer.

The thin-film electromagnet may further include a protection layer covering the first magnetic yoke, the second magnetic yoke and the thin-film coil therewith, in which case, the protection layer may be planarized at a surface thereof, and the surface of the first magnetic yoke, constituting the magnetic pole, may be exposed to a planarized surface of the protection layer.

It is preferable that the first and second magnetic yokes have a thickness in the range of 0.1 micrometer to 200 micrometers both inclusive, and it is more preferable that the first and second magnetic yokes have a thickness in the range of 1 micrometer to 50 micrometers both inclusive.

For instance, the first magnetic yoke may be arranged above the second magnetic yoke, and the first magnetic yoke may be comprised of a central portion located at a center of the winding of the thin-film coil, a body portion making contact above the central portion with the central portion, and extending in parallel with the second magnetic yoke in a direction in which the second magnetic yoke extends, and projecting portions upwardly projecting at opposite ends of the body portion.

The present invention further provides a method of fabricating a thin-film electromagnet including a magnetic yoke and a thin-film coil, the magnetic yoke including a first magnetic yoke and a second magnetic yoke making contact with the first magnetic yoke, the first magnetic yoke being located at a center of a winding of the thin-film coil, the method including the first step of forming the second magnetic yoke on a substrate, the second step of forming an insulating layer on the second magnetic yoke for electrically insulating the second magnetic yoke and the thin-film coil from each other, the third step of forming the thin-film coil on the insulating layer, the fourth step of forming an insulating layer covering the thin-film coil therewith, the fifth step of forming the first magnetic yoke on the second magnetic yoke, the sixth step of forming a protection film entirely covering a resultant resulted from the fifth step, and the seventh step of planarizing the protection film such that the first magnetic yoke is exposed to a surface of the protection film.

The present invention further provides a switching device including the above-mentioned thin-film electromagnet, and a swingable unit, wherein the swingable unit includes a pillar, and a swinger supported on the pillar for making swing-movement about the pillar, and switching is carried out by turning on and off electromagnetic force generated between the thin-film electromagnet and the swinger.

For instance, the first magnetic yoke may be designed to face the swinger.

For instance, the swinger may be designed to be supported on the pillar with a spring being arranged therebetween.

For instance, the spring may be composed of amorphous metal or shape memory metal.

For instance, the swinger may be designed to have magnetic substance.

It is preferable that the magnetic substance has remanent magnetism.

The present invention further provides a switching device including a first thin-film electromagnet, a substrate in which the first thin-film electromagnet is buried, a first electrical contact formed on a surface of the substrate, a swinger rotatable in a plane vertical to the substrate by virtue of magnetic force generated by the first thin-film electromagnet, and a second electrical contact formed on the swinger such that the second electrical contact makes contact with the first electrical contact when the swinger rotates towards the substrate, wherein the first thin-film electromagnet includes a thin-film electromagnet as defined above.

For instance, the first electrical contact may be formed on a surface of the substrate above the first thing-film electromagnet in electrical insulation from the first thin-film electromagnet.

The first electrical contact may be formed on a surface of the substrate away from the first thin-film electromagnet, and the swinger may be designed to rotate about an intermediate point between the first thin-film electromagnet and the first electrical contact.

The present invention further provides a switching device including a first thin-film electromagnet, a second thin-film electromagnet, a substrate in which the first and second thin-film electromagnets are buried, a first electrical contact formed on a surface of the substrate above the first thin-film electromagnet in electrical insulation from the first thin-film electromagnet, a second electrical contact formed on a surface of the substrate above the second thin-film electromagnet in electrical insulation from the second thin-film electromagnet, a swinger rotatable in a plane vertical to the substrate about an intermediate point between the first thin-film electromagnet and the second thin-film electromagnet, a third electrical contact formed on the swinger such that the third electrical contact makes contact with the first electrical contact when the swinger rotates towards the first thin-film electromagnet, and a fourth electrical contact formed on the swinger such that the fourth electrical contact makes contact with the second electrical contact when the swinger rotates towards the second thin-film electromagnet, wherein each of the first and second thin-film electromagnets includes one of the above-mentioned thin-film electromagnets.

The switching device may further include connectors formed on opposite ends of the swinger, and extensions extending in a direction in which the swinger extends and attached to the swinger through the connectors, in which case, the third and fourth electrical contacts are formed on the extensions.

The swinger may be designed to have a light-reflective surface.

The present invention further provides a switching device including a first thin-film electromagnet, a substrate in which the first thin-film electromagnet is buried, and a swinger rotatable in a plane vertical to the substrate by virtue of magnetic force generated by the first thin-film electromagnet, wherein the swinger has a light-reflective surface, and the first thin-film electromagnet includes one of the above-mentioned thin-film electromagnets.

For instance, the swinger may be covered partially or wholly at a surface thereof with gold or silver.

The swinger may be designed to have a mirror unit for reflecting light.

The present invention provides a switching device including a first thin-film electromagnet, a substrate in which the first thin-film electromagnet is buried, a swinger rotatable in a plane vertical to the substrate by virtue of magnetic force generated by the first thin-film electromagnet, and a mirror unit mounted on the swinger for reflecting light, wherein the first thin-film electromagnet includes one of the above-mentioned thin-film electromagnets.

For instance, the mirror unit may be formed by forming a sacrificial layer on the swinger, forming a metal or insulating film on the sacrificial layer which film will make the mirror unit, patterning the metal or insulating film, and removing the sacrificial layer.

The switching device may further include a pair of pillars arranged facing each other outside the swinger in a width-wise direction of the swinger, and a pair of springs mounted on the pillars and extending towards the swinger, in which case, the swinger is supported at its opposite edges in its width-wise direction by the springs arranged such that a line connecting the springs to each other passes a center of the swinger in its length-wise direction.

The present invention further provides a switching device including one of the above-mentioned thin-film electromagnets, and a swingable unit, wherein the swingable unit includes a pillar, and a cantilever supported on the pillar for making swing-movement about the pillar, and switching is carried out by turning on and off electromagnetic force generated between the thin-film electromagnet and a free end of the cantilever.

The present invention further provides a method of fabricating the above-mentioned switching device, including the first step of forming the second magnetic yoke on a substrate, the second step of forming an insulating layer on the second magnetic yoke for electrically insulating the second magnetic yoke and the thin-film coil from each other, the third step of forming the thin-film coil on the insulating layer, the fourth step of forming an insulating layer covering the thin-film coil therewith, the fifth step of forming the first magnetic yoke on the second magnetic yoke, the sixth step of forming a protection film entirely covering a resultant resulted from the fifth step, the seventh step of planarizing the protection film such that the first magnetic yoke is exposed to a surface of the protection film, the eighth step of forming an electrical contact on the protection layer, the ninth step of forming a sacrificial layer on the protection layer, the sacrificial layer having a pattern in which openings are formed in predetermined areas, the tenth step of filling the openings with a predetermined material to form a pillar by which the swinger is supported, the eleventh step of forming the swinger on the sacrificial layer, and the twelfth step of removing the sacrificial layer.

The thin-film electromagnet in accordance with the present invention makes it possible for a magnetic yoke which is magnetized by a magnetic field generated by a thin-film coil, to have a sufficient length, ensuring reduction in a diamagnetic field. A substantial factor defining a length of a magnetic yoke is a size of a substrate on which the thin-film electromagnet is fabricated. In the thin-film electromagnet in accordance with the present invention, the first magnetic yoke makes contact with the second magnetic yoke. That is, the first and second magnetic yokes make contact with each other not only directly, but also magnetically.

Fabrication of an electromagnet through a thin-film fabrication process makes it possible to fabricate a plurality of electromagnets in desired arrangement on a large-size wafer, and further, to fabricate a tiny electromagnet which was not able to be fabricated by means of conventional machines. In addition, by highly integrating electromagnets, it would be possible to increase a number of electromagnets to be fabricated on a wafer, ensuring reduction in fabrication costs.

Furthermore, the present invention provides a switching device including the above-mentioned thin-film electromagnet and a swingable unit, wherein the swingable unit includes a pillar, and a swinger supported on the pillar for making swing-movement about the pillar, and switching is carried out by turning on and off electromagnetic force generated between the thin-film electromagnet and the swinger.

Since the switching device includes the above-mentioned thin-film electromagnet as one of components, it is possible for a magnetic yoke which is magnetized by a magnetic field generated by a thin-film coil, to have a sufficient length, ensuring reduction in a diamagnetic field.

DETAILED DESCRIPTION OF THE PREFERRED EMBODIMENTS

First Embodiment

Figure 1A:
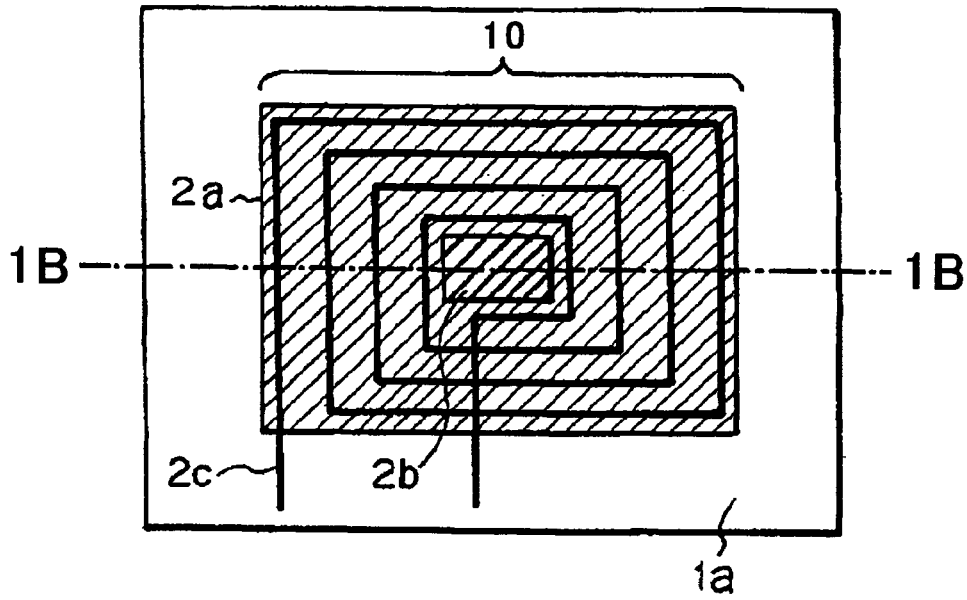
FIG. 1A is a plan view of a thin-film electromagnet in accordance with the first embodiment of the present invention.
Figure 1B:
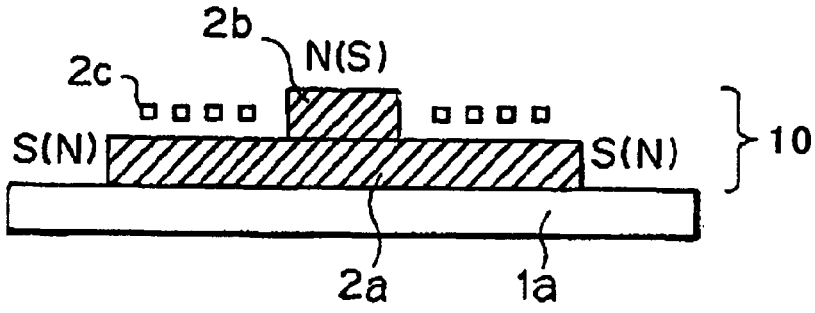
FIG. 1B is a cross-sectional view taken along the line 1B—1B in FIG. 1A.

FIGS. 1A and 1B illustrate a thin-film electromagnet 10 in accordance with the first embodiment of the present invention. FIG. 1A is an upper plan view of the thin-film electromagnet 10, and FIG. 1B is a cross-sectional view taken along the line 1B—1B in FIG. 1A.

The thin-film electromagnet 10 in accordance with the first embodiment includes a magnetic yoke and a thin-film coil 2*c*. The magnetic yoke includes a rectangular first magnetic yoke 2*b*, and a rectangular second magnetic yoke 2*a* making contact with the first magnetic yoke 2*b*.

The thin-film electromagnet 10 in accordance with the first embodiment is fabricated on a substrate 1*a*. That is, the second magnetic yoke 2*a* is formed on the substrate 1*a* almost at a center of the substrate 1*a*, and the first magnetic yoke 2*b* is formed on the second magnetic yoke 2*a* almost at a center of the second magnetic yoke 2*a*.

The thin-film coil 2*c* intersects with the first magnetic yoke 2*b* at a center of a winding of which the thin-film coil 2*c* is comprised.

The first magnetic yoke 2*b* and the second magnetic yoke 2*a* make magnetic contact with each other.

As illustrated in FIGS. 1A and 1B, the second magnetic yoke 2*a* is arranged below the thin-film coil 2*c*, facing the thin-film coil 2*c*, and has a size sufficient to entirely overlap the thin-film coil 2*c*.

By flowing a current through the thin-film coil 2*c*, the first magnetic yoke 2*b* and the second magnetic yoke 2*b* are magnetized, and thus, as illustrated in FIG. 1B, the first magnetic yoke 2*b* produces N-polarity (or S-polarity), and the second magnetic yoke 2*a* produces S-polarity (or N-polarity). That is, the first magnetic yoke 2*b* and the second magnetic yoke 2*a* produce polarities opposite to each other.

Since the second magnetic yoke 2*a* can be formed sufficiently large in a plane, it is possible to reduce a diamagnetic field, and thus, the magnetic yoke can be readily magnetized even by a small coil current.

In the first embodiment, the second magnetic yoke 2*a* is designed to be shorter than the substrate 1*a*, but the second magnetic yoke 2*a* can be designed to have a length reaching opposite ends of the substrate 1*a* at maximum.

FIGS. 2A to 2H are cross-sectional views showing respective steps of a method of fabricating the thin-film electromagnet 10 in accordance with the first embodiment.

Figure 2A:
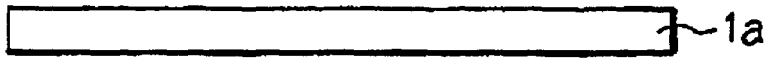
FIGS. 2A to 2H are cross-sectional views showing respective steps of a method of fabricating the thin-film electromagnet in accordance with the first embodiment of the present invention, illustrated in FIGS. 1A and 1B.

First, there is prepared the substrate 1*a* (FIG. 2A). The substrate 1*a* is composed of ceramic predominantly containing alumina. The substrate 1*a* may be composed of other ceramics or silicon.

Figure 2B:
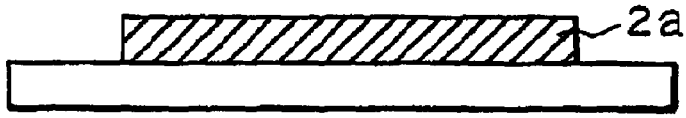

Then, the second magnetic yoke 2*a* is formed on the substrate 1*a* (FIG. 2B).

The second magnetic yoke 2*a* has a thickness of 5 micrometers, and is composed of Ni—Fe alloy. The second magnetic yoke 2*a* can be fabricated by electro-plating. The second magnetic yoke 2*a* may be composed of any material, if it provides high saturation magnetization and has high magnetic permeability. The second magnetic yoke 2*a* may be composed of, for instance, microcrystal alloy containing Fe, such as Co—Ni—Fe alloy or Fe—Ta—N, amorphous alloy containing Co, such as Co—Ta—Zr, or soft iron.

A film of which the second magnetic yoke 2*a* is comprised can be formed by sputtering or evaporation as well as electro-plating.

A film of which the second magnetic yoke 2*a* is comprised has a thickness preferably in the range of 0.1 micrometer to 200 micrometers, and more preferably in the range of 1 micrometer to 50 micrometers.

Figure 2C:
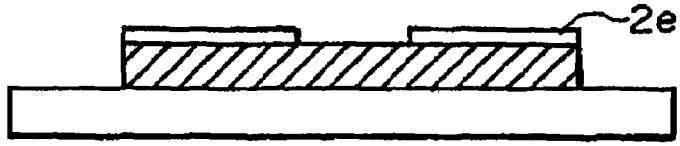

Then, an electrically insulating layer 2*e* is formed on the second magnetic yoke 2*a* for electrically insulating the second magnetic yoke 2*a* and the thin-film coil 2*c* from each other (FIG. 2C).

As illustrated in FIG. 2C, the electrically insulating layer 2*e* has an opening in which the first magnetic yoke 2*b* will be formed later.

The electrically insulating layer 2*e* includes photoresist having been baked at 250 degrees centigrade. The electrically insulating layer 2*e* may be comprised of an alumina film or a silicon dioxide film formed by sputtering as well as photoresist.

Figure 2D:
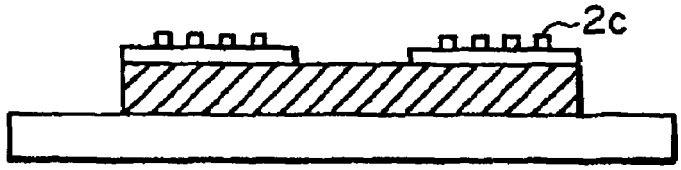

Then, the thin-film coil 2*c* is formed on the electrically insulating layer 2*e* (FIG. 2D).

The thin-film coil 2*c* is formed by forming a photoresist mask having a coil-shaped opening, and growing copper (Cu) in the opening by electro-plating to thereby have a coil having a desired shape.

Figure 2E:
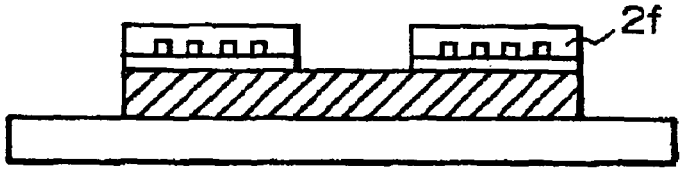

Then, on the electrically insulating layer 2*e* is formed an electrically insulating layer 2*f* such that the electrically insulating layer 2*f* covers the thin-film coil 2*c* (FIG. 2E). The electrically insulating layer 2*f* insulates the thin-film coil 2*c* from others and protects the thin-film coil 2*c*.

The electrically insulating layer 2*f* includes photoresist having been baked at 250 degrees centigrade. The electrically insulating layer 2*f* may be comprised of an alumina film or a silicon dioxide film formed by sputtering as well as photoresist.

Figure 2F:
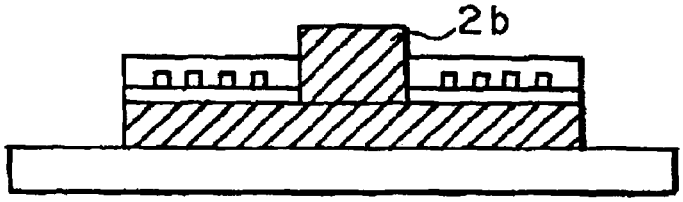

Then, the first magnetic yoke 2*b* is formed on the second magnetic yoke 2*a* (FIG. 2F).

The first magnetic yoke 2*b* has a thickness of 20 micrometers, and is composed of Ni—Fe alloy. The first magnetic yoke 2*b* can be fabricated by electro-plating.

The first magnetic yoke 2*b* may be composed of any material, if it provides high saturation magnetization and has high magnetic permeability. The first magnetic yoke 2*b* may be composed of, for instance, microcrystal alloy containing Fe, such as Co—Ni—Fe alloy or Fe—Ta—N, amorphous alloy containing Co, such as Co—Ta—Zr, or soft iron.

A film of which the first magnetic yoke 2*b* is comprised can be formed by sputtering or evaporation as well as electro-plating.

A film of which the first magnetic yoke 2*b* is comprised has a thickness preferably in the range of 0.1 micrometer to 200 micrometers, and more preferably in the range of 1 micrometer to 50 micrometers.

Figure 2G:
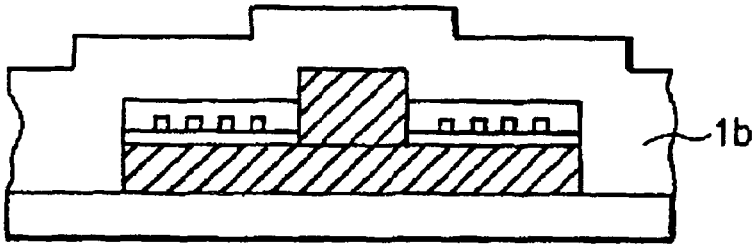

Then, the resultant is entirely covered with an alumina film 1*b* formed by sputtering (FIG. 2G).

Figure 2H:
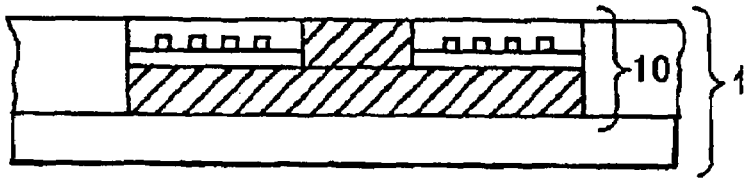

Then, the alumina film 1*b* is polished for planarization such that the first magnetic yoke 2*b* acting as magnetic pole is exposed to a planarized surface of the alumina film 1*b* (FIG. 2H).

Thus, there is completed a unit 1 including the thin-film electromagnet 10.

Since the first magnetic yoke 2*b* acting as magnetic pole is exposed to a surface of the unit 1, and a surface of the unit 1 is planarized, it is possible to form other unit on the unit 1 without any preparation.

Fabrication of an electromagnet through a thin-film fabrication process makes it possible to fabricate a plurality of electromagnets in desired arrangement on a large-size wafer, and further, to fabricate a tiny electromagnet which was not able to be fabricated by means of conventional machines.

In addition, by highly integrating electromagnets, it would be possible to increase a number of electromagnets to be fabricated on a wafer, ensuring reduction in fabrication costs.

Second Embodiment

Figure 3A:
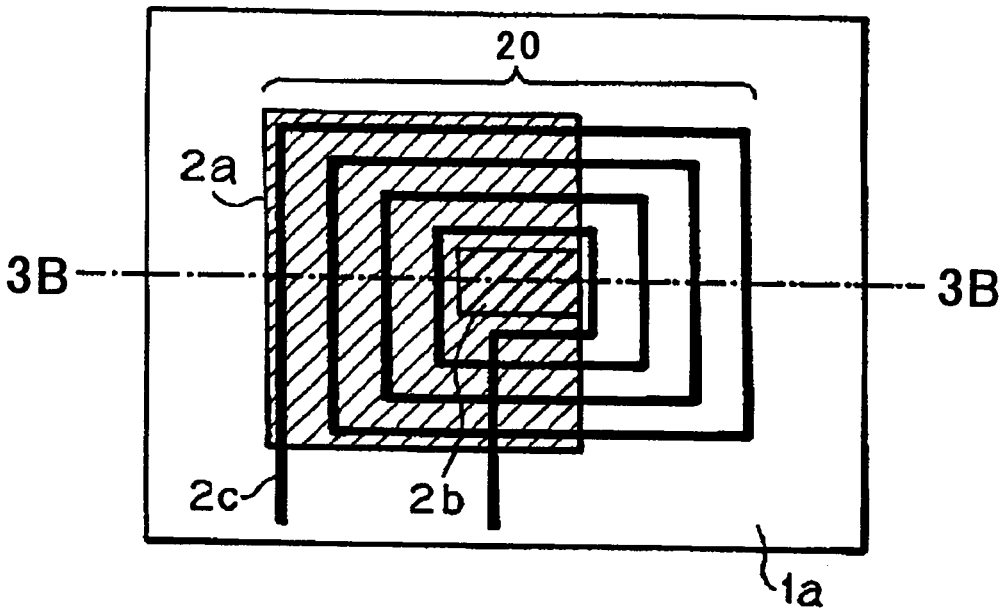
FIG. 3A is a plan view of a thin-film electromagnet in accordance with the second embodiment of the present invention.
Figure 3B:
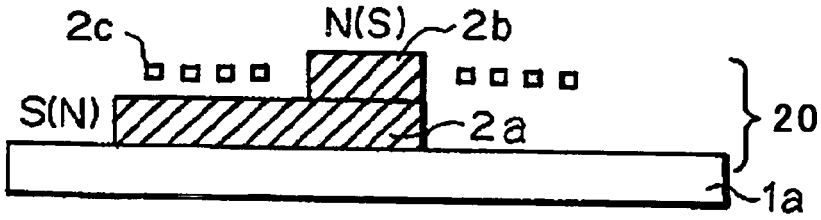
FIG. 3B is a cross-sectional view taken along the line 3B—3B in FIG. 3A.

FIGS. 3A and 3B illustrate a thin-film electromagnet 20 in accordance with the second embodiment of the present invention. FIG. 3A is an upper plan view of the thin-film electromagnet 20, and FIG. 3B is a cross-sectional view taken along the line 3B—3B in FIG. 3A.

Whereas the second magnetic yoke 2*a* is formed so as to entirely overlap the thin-film coil 2*c* in the thin-film electromagnet 10 in accordance with the first embodiment, illustrated in FIGS. 1A and 1B, the second magnetic yoke 2*a* is designed not to have a size beyond the first magnetic yoke 2*b* in the thin-film electromagnet 20 in accordance with the second embodiment. Specifically, the second magnetic yoke 2*a* overlaps almost a half of the thin-film coil 2*c*. The thin-film electromagnet 20 has the same structure as that of the thin-film electromagnet 10 in accordance with the first embodiment except the second magnetic yoke 2*a*.

Similarly to the thin-film electromagnet 10 in accordance with the first embodiment, the thin-film electromagnet 20 in accordance with the second embodiment provides an advantage that since the second magnetic yoke 2*a* can be formed sufficiently large in a plane, it is possible to reduce a diamagnetic field, and thus, the magnetic yoke can be readily magnetized even by a small coil current.

Third Embodiment

Figure 4A:
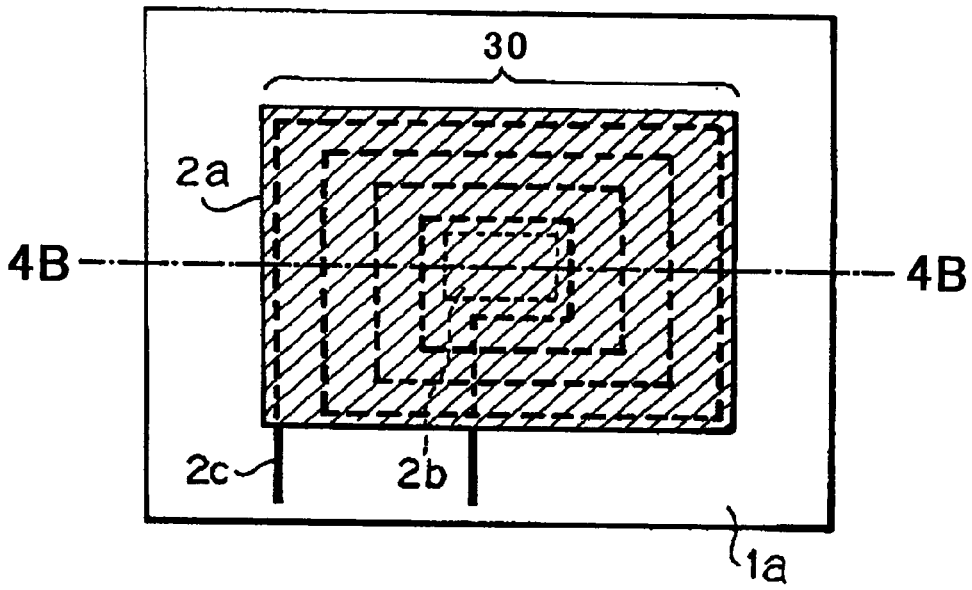
FIG. 4A is a plan view of a thin-film electromagnet in accordance with the third embodiment of the present invention.
Figure 4B:
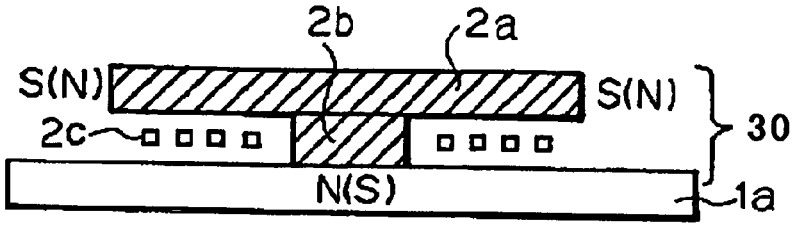
FIG. 4B is a cross-sectional view taken along the line 4B—4B in FIG. 4A.

FIGS. 4A and 4B illustrate a thin-film electromagnet 30 in accordance with the third embodiment of the present invention. FIG. 4A is an upper plan view of the thin-film electromagnet 30, and FIG. 4B is a cross-sectional view taken along the line 4B—4B in FIG. 4A.

The thin-film electromagnet 30 in accordance with the third embodiment includes a magnetic yoke and a thin-film coil 2*c*. The magnetic yoke includes a rectangular first magnetic yoke 2*b*, and a rectangular second magnetic yoke 2*a* making contact with the first magnetic yoke 2*b*.

The thin-film electromagnet 30 in accordance with the third embodiment is fabricated on a substrate 1*a*. That is, the first magnetic yoke 2*b* is formed on the substrate 1*a* almost at a center of the substrate 1*a*, and the second magnetic yoke 2*a* is formed on the first magnetic yoke 2*b* concentrically with the first magnetic yoke 2*b*.

The thin-film coil 2*c* intersects with the first magnetic yoke 2*b* at a center of a winding of which the thin-film coil 2*c* is comprised.

The first magnetic yoke 2*b* and the second magnetic yoke 2*a* make magnetic contact with each other.

As illustrated in FIGS. 4A and 4B, the second magnetic yoke 2*a* is arranged above the thin-film coil 2*c*, facing the thin-film coil 2*c*, and has a size sufficient to entirely overlap the thin-film coil 2*c*.

The second magnetic yoke 2*a* in the thin-film electromagnet 30 in accordance with the third embodiment is positioned differently from the second magnetic yoke 2*a* in the thin-film electromagnet 10 in accordance with the first embodiment, illustrated in FIGS. 1A and 1B. Whereas the second magnetic yoke 2*a* in the thin-film electromagnet 10 is arranged below the thin-film coil 2*c* in the thin-film electromagnet 10 in accordance with the first embodiment, the second magnetic yoke 2*a* is arranged above the thin-film coil 2*c* in the thin-film electromagnet 30 in accordance with the third embodiment.

By flowing a current through the thin-film coil 2*c*, the first magnetic yoke 2*b* and the second magnetic yoke 2*b* are magnetized, and thus, as illustrated in FIG. 4B, the first magnetic yoke 2*b* produces N-polarity (or S-polarity), and the second magnetic yoke 2*a* produces S-polarity (or N-polarity). That is, the first magnetic yoke 2*b* and the second magnetic yoke 2*a* produce polarities opposite to each other.

Since the second magnetic yoke 2*a* can be formed sufficiently large in a plane, it is possible to reduce a diamagnetic field, and thus, the magnetic yoke can be readily magnetized even by a small coil current.

In the third embodiment, the second magnetic yoke 2*a* is designed to be shorter than the substrate 1*a*, but the second magnetic yoke 2*a* can be designed to have a length reaching opposite ends of the substrate 1*a* at maximum.

Fourth Embodiment

Figure 5A:
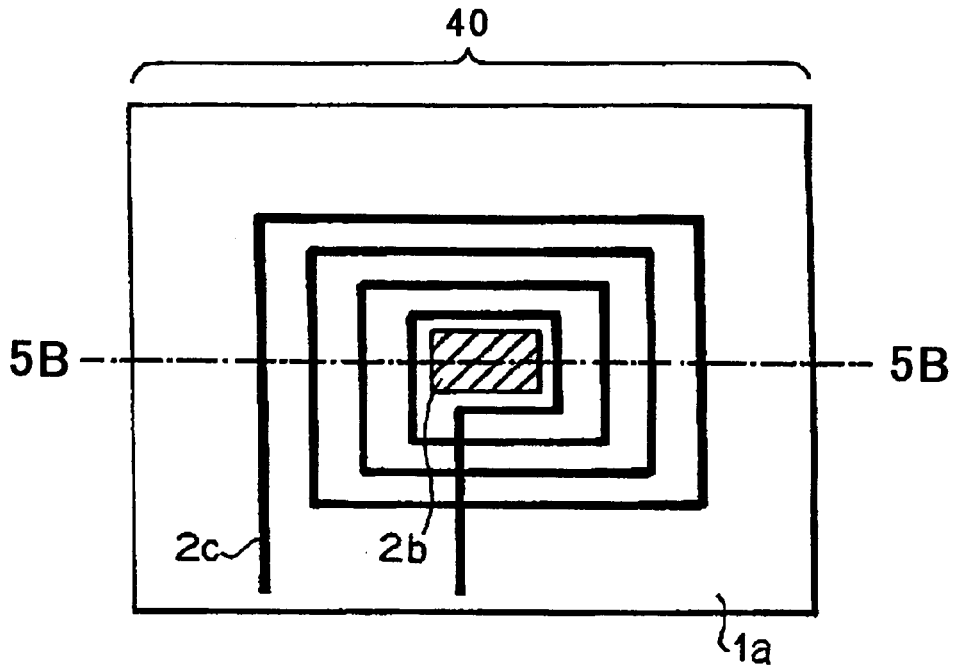
FIG. 5A is a plan view of a thin-film electromagnet in accordance with the fourth embodiment of the present invention.
Figure 5B:
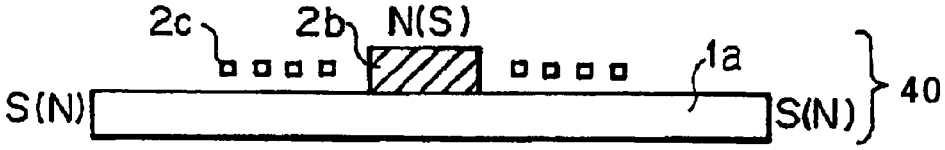
FIG. 5B is a cross-sectional view taken along the line 5B—5B in FIG. 5A.

FIGS. 5A and 5B illustrate a thin-film electromagnet 40 in accordance with the fourth embodiment of the present invention. FIG. 5A is an upper plan view of the thin-film electromagnet 40, and FIG. 5B is a cross-sectional view taken along the line 5B—5B in FIG. 5A.

The thin-film electromagnet 40 in accordance with the fourth embodiment includes a substrate 1*a*, a rectangular first magnetic yoke 2*b*, and a thin-film coil 2*c*.

The first magnetic yoke 2*b* is formed on the substrate 1*a* almost at a center of the substrate 1*a*.

The thin-film coil 2*c* intersects with the first magnetic yoke 2*b* at a center of a winding of which the thin-film coil 2*c* is comprised.

In the fourth embodiment, the substrate 1*a* is composed of MnZn ferrite. Thus, the substrate 1*a* acts also as the second magnetic yoke 2*a* of the first embodiment.

The substrate 1*a* may be composed of soft magnetic ferrite such as NiZn ferrite or soft magnetic substance such as Ni—Fe alloy or Fe—S—Al alloy.

The first magnetic yoke 2*b* and the substrate 1*a* make magnetic contact with each other.

As illustrated in FIGS. 5A and 5B, the substrate 1*a* acting as the second magnetic yoke 2*a* has a size sufficient to entirely overlap the thin-film coil 2*c*.

By flowing a current through the thin-film coil 2*c*, the first magnetic yoke 2*b* and the substrate 1*a* are magnetized, and thus, as illustrated in FIG. 5B, the first magnetic yoke 2*b* produces N-polarity (or S-polarity), and the substrate 1*a* acting also as the second magnetic yoke 2*a* produces S-polarity (or N-polarity). That is, the first magnetic yoke 2*b* and the substrate 1*a* produce polarities opposite to each other.

Similarly to the thin-film electromagnet 10 in accordance with the first embodiment, the thin-film electromagnet 40 in accordance with the fourth embodiment provides an advantage that since the substrate 1*a* acting also as the second magnetic yoke 2*a* can be formed sufficiently large, it is possible to reduce a diamagnetic field, and thus, the magnetic yoke can be readily magnetized even by a small coil current.

In addition, since the substrate 1*a* acts also as the second magnetic yoke 2*a*, it is possible to reduce a number of parts used for constituting the thin-film electromagnet 40.

Fifth Embodiment

Figure 6A:
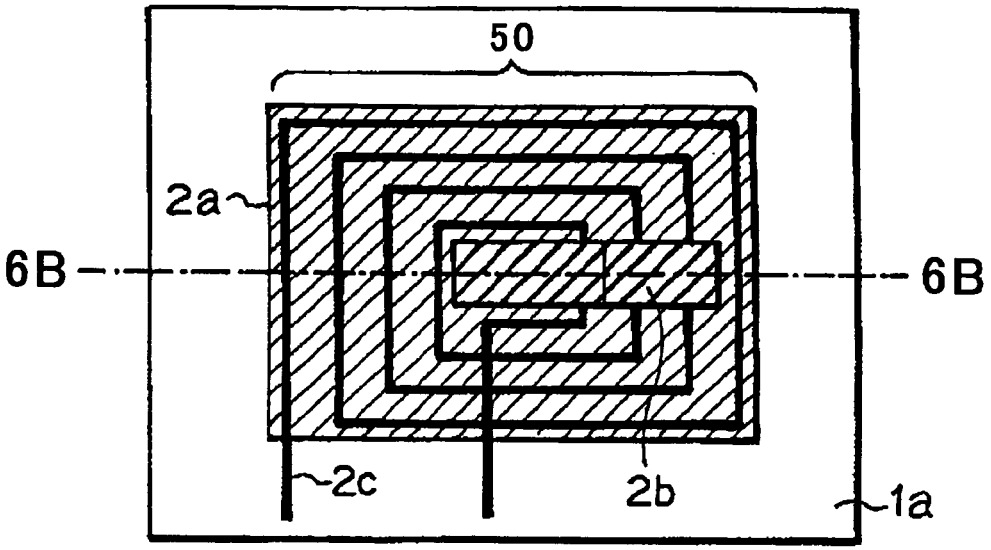
FIG. 6A is a plan view of a thin-film electromagnet in accordance with the fifth embodiment of the present invention.
Figure 6B:
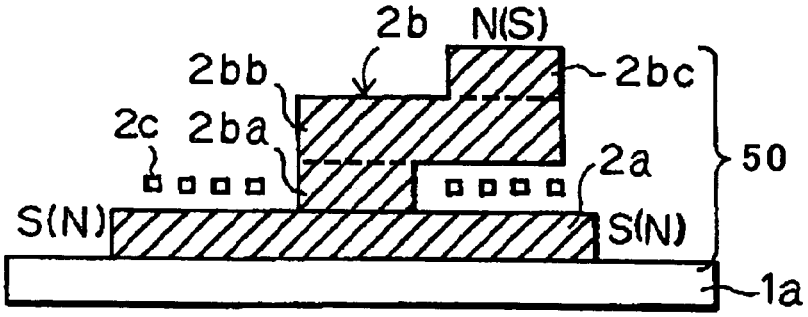
FIG. 6B is a cross-sectional view taken along the line 6B—6B in FIG. 6A.

FIGS. 6A and 6B illustrate a thin-film electromagnet 50 in accordance with the fifth embodiment of the present invention. FIG. 6A is an upper plan view of the thin-film electromagnet 50, and FIG. 6B is a cross-sectional view taken along the line 6B—6B in FIG. 6A.

The thin-film electromagnet 50 in accordance with the fifth embodiment includes a magnetic yoke and a thin-film coil 2*c*. The magnetic yoke includes a first magnetic yoke 2*b*, and a rectangular second magnetic yoke 2*a* making contact with the first magnetic yoke 2*b*.

The thin-film electromagnet 50 in accordance with the fifth embodiment is fabricated on a substrate 1*a*. That is, the second magnetic yoke 2*a* is formed on the substrate 1*a* almost at a center of the substrate 1*a*, and the first magnetic yoke 2*b* is formed on the second magnetic yoke 2*a*.

The thin-film coil 2*c* intersects with the second magnetic yoke 2*a* at a center of a winding of which the thin-film coil 2*c* is comprised.

The first magnetic yoke 2*b* and the second magnetic yoke 2*a* make magnetic contact with each other.

As illustrated in FIGS. 6A and 6B, the second magnetic yoke 2*a* is arranged below the thin-film coil 2*c*, facing the thin-film coil 2*c*, and has a size sufficient to entirely overlap the thin-film coil 2*c*.

The first magnetic yoke 2*b* in the thin-film electromagnet 50 in accordance with the fifth embodiment is different in shape from the same in the thin-film electromagnet 10 in accordance with the first embodiment, illustrated in FIGS. 1A and 1B. Whereas the first magnetic yoke 2*b* in the thin-film electromagnet 10 in accordance with the first embodiment is designed to be three-dimensional and have a rectangular longitudinal cross-section, the first magnetic yoke 2*b* in the thin-film electromagnet 50 in accordance with the fifth embodiment is designed to be three-dimensional and have a crank-shaped longitudinal cross-section.

Specifically, the first magnetic yoke 2*b* includes a first portion 2*ba* having the same shape as that of the first magnetic yoke 2*b* as a part of the thin-film electromagnet 10 in accordance with the first embodiment, a second portion 2*bb* formed on the first portion 2*ba* and extending over a right half of the thin-film coil 2*c*, and a third portion 2*bc* formed on the second portion 2*bb* and having a length covering a right half of the second portion 2*bb* therewith.

Thus, as illustrated in FIG. 6B, a magnetic polarity of the first magnetic yoke 2*b* is generated at an upper surface of the first magnetic yoke 2*b*. That is, whereas a magnetic polarity of the first magnetic yoke 2*b* is coincident with a center of a winding of which thin-film coil 2*c* is comprised in the thin-film electromagnet 10 in accordance with the first embodiment, a magnetic polarity of the first magnetic yoke 2*b* is not coincident with a center of a winding of which thin-film coil 2*c* is comprised in the thin-film electromagnet 50 in accordance with the fifth embodiment.

Similarly to the thin-film electromagnet 10 in accordance with the first embodiment, the thin-film electromagnet 50 in accordance with the fifth embodiment provides an advantage that since the second magnetic yoke 2*a* can be formed sufficiently large in a plane, it is possible to reduce a diamagnetic field, and thus, the magnetic yoke can be readily magnetized even by a small coil current.

Though the first magnetic yoke 2*b* in the fifth embodiment is designed to be three-dimensional and has a crank-shaped longitudinal cross-section, the first magnetic yoke 2*b* may be designed to be of any shape, if the shape ensues that a magnetic polarity of the first magnetic yoke 2*b* is out of a center of a winding of which thin-film coil 2*c* is comprised.

Sixth Embodiment

Figure 7A:
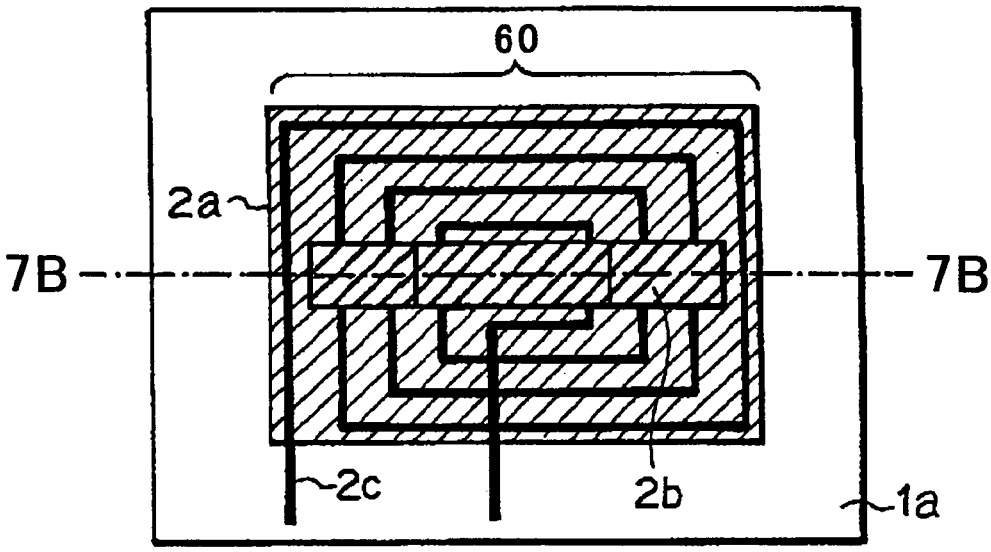
FIG. 7A is a plan view of a thin-film electromagnet in accordance with the sixth embodiment of the present invention.
Figure 7B:
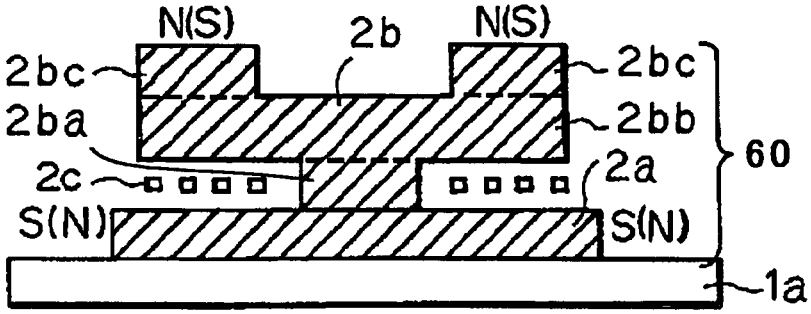
FIG. 7B is a cross-sectional view taken along the line 7B—7B in FIG. 7A.

FIGS. 7A and 7B illustrate a thin-film electromagnet 60 in accordance with the sixth embodiment of the present invention. FIG. 7A is an upper plan view of the thin-film electromagnet 60, and FIG. 7B is a cross-sectional view taken along the line 7B—7B in FIG. 7A.

The thin-film electromagnet 60 in accordance with the sixth embodiment includes a magnetic yoke and a thin-film coil 2*c*. The magnetic yoke includes a first magnetic yoke 2*b*, and a rectangular second magnetic yoke 2*a* making contact with the first magnetic yoke 2*b*.

The thin-film electromagnet 60 in accordance with the sixth embodiment is fabricated on a substrate 1*a*. That is, the second magnetic yoke 2*a* is formed on the substrate 1*a* almost at a center of the substrate 1*a*, and the first magnetic yoke 2*b* is formed on the second magnetic yoke 2*a*.

The thin-film coil 2*c* intersects with the second magnetic yoke 2*a* at a center of a winding of which the thin-film coil 2*c* is comprised.

The first magnetic yoke 2*b* and the second magnetic yoke 2*a* make magnetic contact with each other.

As illustrated in FIGS. 7A and 7B, the second magnetic yoke 2*a* is arranged below the thin-film coil 2*c*, facing the thin-film coil 2*c*, and has a size sufficient to entirely overlap the thin-film coil 2*c*.

The first magnetic yoke 2*b* in the thin-film electromagnet 60 in accordance with the sixth embodiment is different in shape from the same in the thin-film electromagnet 10 in accordance with the first embodiment, illustrated in FIGS. 1A and 1B. Whereas the first magnetic yoke 2*b* in the thin-film electromagnet 10 in accordance with the first embodiment is designed to be three-dimensional and have a rectangular longitudinal cross-section, the first magnetic yoke 2*b* in the thin-film electromagnet 60 in accordance with the sixth embodiment is designed to be three-dimensional and have a clevis-shaped longitudinal cross-section.

Specifically, the first magnetic yoke 2*b* includes a first portion 2*ba* having the same shape as that of the first magnetic yoke 2*b* as a part of the thin-film electromagnet 10 in accordance with the first embodiment, a second portion 2*bb* formed on the first portion 2*ba* and extending over an entire width of the thin-film coil 2*c*, and two third portions 2*bc* formed on opposite ends of the second portion 2*bb* and having a length covering a right half and a left half of the second portion 2*bb* therewith, respectively.

Thus, as illustrated in FIG. 7B, a magnetic polarity of the first magnetic yoke 2*b* is generated at upper surfaces of the two third portions 2*bc*. That is, whereas a magnetic polarity of the first magnetic yoke 2*b* is coincident with a center of a winding of which thin-film coil 2*c* is comprised in the thin-film electromagnet 10 in accordance with the first embodiment, a magnetic polarity of the first magnetic yoke 2*b* is not coincident with a center of a winding of which thin-film coil 2*c* is comprised in the thin-film electromagnet 60 in accordance with the sixth embodiment.

Similarly to the thin-film electromagnet 10 in accordance with the first embodiment, the thin-film electromagnet 60 in accordance with the sixth embodiment provides an advantage that since the second magnetic yoke 2*a* can be formed sufficiently large in a plane, it is possible to reduce a diamagnetic field, and thus, the magnetic yoke can be readily magnetized even by a small coil current.

Though the first magnetic yoke 2*b* in the fifth embodiment is designed to be three-dimensional and has such a longitudinal cross-section as illustrated in FIG. 7B, the first magnetic yoke 2*b* may be designed to be of any shape, if the shape ensues that a magnetic polarity of the first magnetic yoke 2*b* is out of a center of a winding of which thin-film coil 2*c* is comprised.

Seventh Embodiment

Figure 8A:
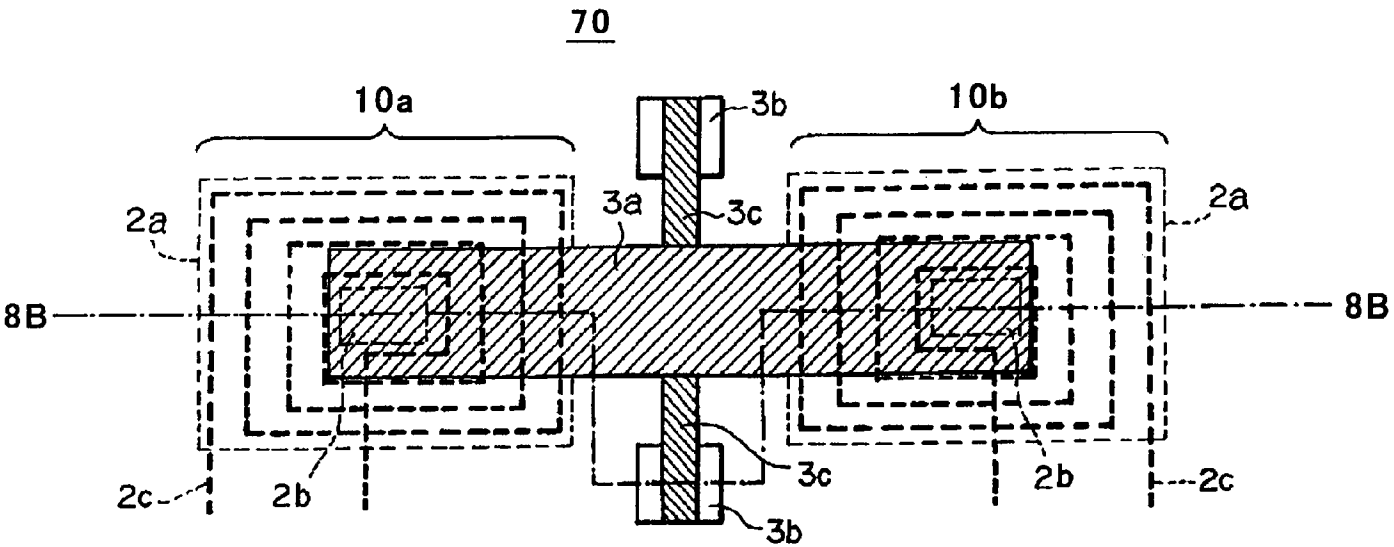
FIG. 8A is a plan view of a switching device in accordance with the seventh embodiment of the present invention.
Figure 8B:
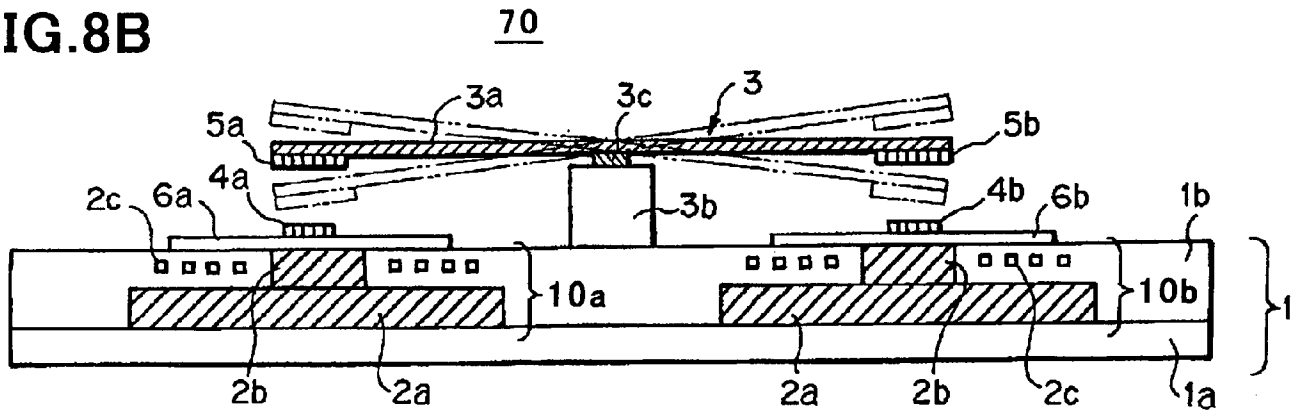
FIG. 8B is a cross-sectional view taken along the line 8B—8B in FIG. 8A.

FIGS. 8A and 8B illustrate a switching device 70 in accordance with the seventh embodiment of the present invention. FIG. 8A is an upper plan view of the switching device 70, and FIG. 8B is a cross-sectional view taken along the line 8B—8B in FIG. 8A.

The switching unit 70 in accordance with the seventh embodiment includes a thin-film electromagnet unit 1, and a swingable unit 3 formed on the thin-film electromagnet unit 1.

The thin-film electromagnet unit 1 includes a substrate 1*a*, a first thin-film electromagnet 10*a* and a second thin-film electromagnet 10*b* both formed on the substrate 1*a*, a protection layer 1*b* formed on the substrate 1*a*, having a planarized surface, and covering the first and second thin-film electromagnets 10*a* and 10*b* therewith such that the first magnet yokes 2*b* of the first and second thin-film electromagnets 10*a* and 10*b* are exposed, electrically insulating layers 6*a* and 6*b* formed on the substrate 1*a*, covering the exposed first magnet yokes 2*b* of the first and second thin-film electromagnets 10*a* and 10*b* therewith, and first electrical contacts 4*a* and 4*b* formed on the electrically insulating layers 6*a* and 6*b* above the first magnet yokes 2*b* of the first and second thin-film electromagnets 10*a* and 10*b*, respectively.

Each of the first and second thin-film electromagnets 10*a* and 10*b* has the same structure as that of the thin-film electromagnet 10 in accordance with the first embodiment, illustrated in FIGS. 1A and 1B.

If necessary, the electrically insulating layers 6*a* and 6*b* may be omitted.

The swingable unit 3 includes a pair of pillars 3*b* formed on a line passing through an intermediate point between the first and second thin-film electromagnets 10*a* and 10*b*, a pair of springs 3*c* each formed on each of the pillars 3*b*, and extending towards the facing spring 3*b*, a swinger 3*a* supported on the pair of springs 3*c*, and having a length across the first electrical contacts 4*a* and 4*b*, and second electrical contacts 5*a* and 5*b* formed on a lower surface of the swinger 3*a* at opposite ends of the swinger 3*a*.

The swinger 3*a* rotates about a center of the springs 3*c* in a plane perpendicular to the substrate 1*a*, as a result that magnetic force generated by the first and second thin-film electromagnets 10*a* and 10*b* acts on the swinger 3*a*. Thus, as mentioned later, the second electrical contact 5*a* or 5*b* makes contact with the first electrical contact 4*a* or 4*b*, respectively.

The swinger 3*a* is composed of magnetic substance. Hence, electromagnetic force is generated between opposite ends of the swinger 3*a* and upper surfaces of the first magnetic yoke 2*b* acting as magnetic polarities of the first and second thin-film electromagnets 10*a* and 10*b*.

As magnetic substance of which the swinger 3*a* is composed, soft magnetic substance may be selected. For instance, as soft magnetic substance, there may be selected microcrystal alloy containing Fe, such as Ni—Fe alloy, Co—Ni—Fe alloy or Fe—Ta—N, amorphous alloy containing Co, such as Co—Ta—Zr, or soft iron.

By alternately flowing a current through the thin-film coils 2*c* of the first and second thin-film electromagnets 10*a* and 10*b*, magnetic flux is generated alternately from the first magnetic yokes 2*b* of the first and second thin-film electromagnets 10*a* and 10*b*, and thus, the swinger 3*a* is attracted to the first magnetic yoke 2*b* from which magnetic flux is generated. As a result, the second electrical contact 5*a* or 5*b* makes contact with the first electrical contact 4*a* or 4*b*, respectively, and thus, switching is carried out.

Magnetic substance of which the swinger 3*a* is composed is preferably magnetic substance which readily produces residual magnetization. As such magnetic substance, there may be selected Co—Cr—Pt alloy, Co—Cr—Ta alloy, Sm—Co alloy, Nd—Fe—B alloy, Fe—Al—Ni—Co alloy, Fe—Cr—Co alloy, Co—Fe—V alloy or Cu—Ni—Fe alloy, for instance.

The swinger 3*a* composed of magnetic substance which readily produces residual magnetization is magnetized in a left-right direction in FIG. 8A such that its left side has N-polarity and its right side has S-polarity, for instance.

The first and second thin-film electromagnets 10*a* and 10*b* operate such that the first magnetic yokes 2*b* of them are concurrently turned at surfaces thereof into N- or S-polarity.

Thus, if the first magnetic yokes 2*b* of the first and second thin-film electromagnets 10*a* and 10*b* are concurrently turned at surfaces thereof into N-polarity, attractive force is generated between the second thin-film electromagnet 10*b* and the swinger 3*a*, and repulsive force is generated between the first thin-film electromagnet 10*a* and the swinger 3*a*. As a result, the swinger 3*a* rotates about the springs 3*c* in a clockwise direction in FIG. 8B. Thus, the second electrical contact 5*b* of the swinger 3*a* makes contact with the first electrical contact 4*b*, and the second electrical contact 5*a* of the first thin-film electromagnet 10*a* is disconnected from the first electrical contact 4*a*.

Even if a coil current is interrupted in such a condition, attractive force is kept generated due to the residual magnetization of the swinger 3*a* between the pole of the second thin-film electromagnet 10*b* and the swinger 3*a*, and thus, the second electrical contact 5*b* of the swinger 3*a* is kept in contact with the first electrical contact 4*b*, ensuring on-condition is kept between the second electrical contact 5*b* of the swinger 3*a* and the first electrical contact 4*b*.

If the first magnetic yokes 2*b* of the first and second thin-film electromagnets 10*a* and 10*b* are concurrently turned at surfaces thereof into S-polarity, repulsive force is generated between the second thin-film electromagnet 10*b* and the swinger 3*a*, and attractive force is generated between the first thin-film electromagnet 10*a* and the swinger 3*a*. As a result, the swinger 3*a* rotates about the springs 3*c* in a counterclockwise direction in FIG. 8B. Thus, the second electrical contact 5*b* of the swinger 3*a* is disconnected from the first electrical contact 4*b*, and the second electrical contact 5*a* of the first thin-film electromagnet 10*a* makes contact with the first electrical contact 4*a*.

It is not always necessary for the swinger 3*a* to be composed wholly of the above-mentioned magnetic substance, but the swinger 3*a* may be composed partially of the above-mentioned magnetic substance.

Figure 9A:
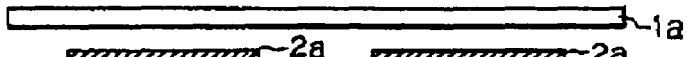
FIGS. 9A to 9N are cross-sectional views showing respective steps of a method of fabricating the switching device in accordance with the seventh embodiment of the present invention, illustrated in FIGS. 8A and 8B.
Figure 9B:
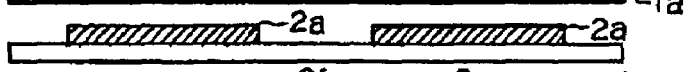
Figure 9C:
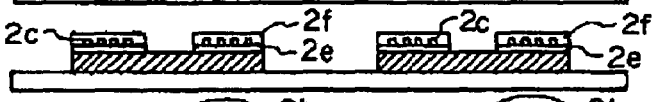
Figure 9D:
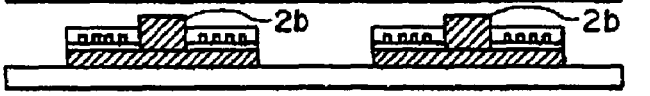
Figure 9E:
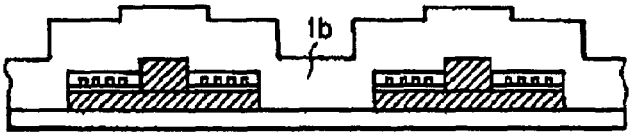
Figure 9F:
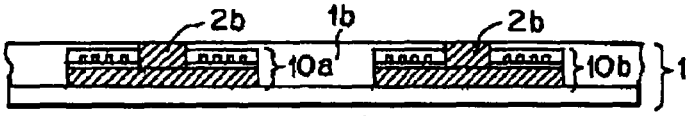
Figure 9G:
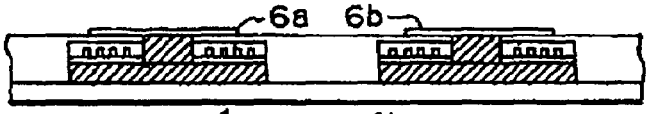
Figure 9H:
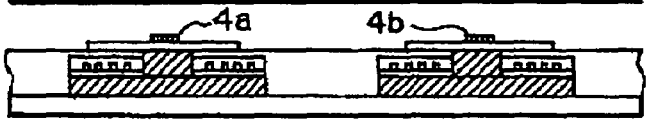
Figure 9I:
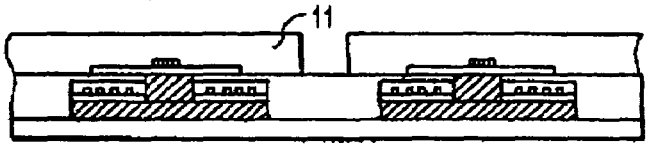
Figure 9J:
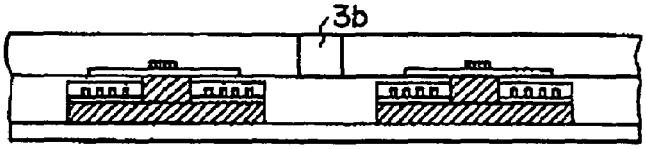
Figure 9K:
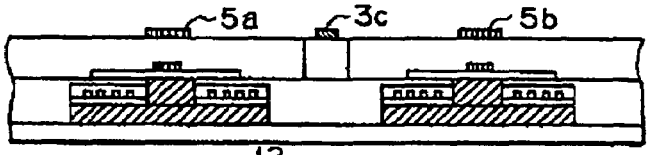
Figure 9L:
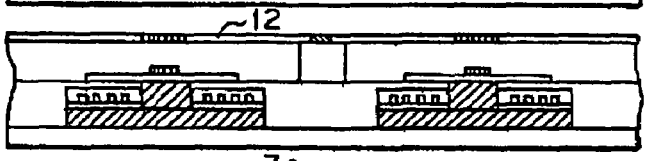
Figure 9M:
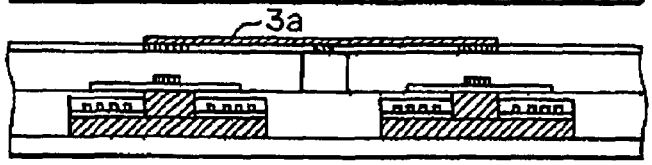
Figure 9N:
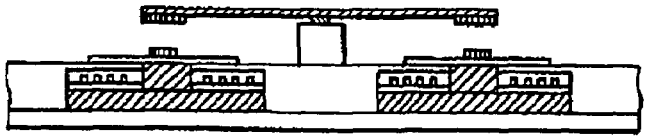

FIGS. 9A to 9N illustrate respective steps of a method of fabricating the switching device in accordance with the sixth embodiment, illustrated in FIG. 8.

First, there is prepared the substrate 1*a* (FIG. 9A). The substrate 1*a* is composed of ceramic predominantly containing alumina. The substrate 1*a* may be composed of other ceramics or silicon.

Then, the second magnetic yokes 2*a* of the first and second thin-film electromagnets 10*a* and 10*b* are formed on the substrate 1*a* (FIG. 9B).

The second magnetic yokes 2*a* have a thickness of 5 micrometers, and are composed of Ni—Fe alloy. The second magnetic yokes 2*a* can be fabricated by electro-plating.

The second magnetic yokes 2*a* may be composed of any material, if it provides high saturation magnetization and has high magnetic permeability. The second magnetic yokes 2*a* may be composed of, for instance, microcrystal alloy containing Fe, such as Co—Ni—Fe alloy or Fe—Ta—N, amorphous alloy containing Co, such as Co—Ta—Zr, or soft iron.

A film of which the second magnetic yoke 2*a* is comprised can be formed by sputtering or evaporation as well as electro-plating.

A film of which the second magnetic yoke 2*a* is comprised has a thickness preferably in the range of 0.1 micrometer to 200 micrometers, and more preferably in the range of 1 micrometer to 50 micrometers.

Then, an electrically insulating layer 2*e* is formed on the second magnetic yoke 2*a* for electrically insulating the second magnetic yoke 2*a* and the thin-film coil 2*c* from each other (FIG. 9C).

As illustrated in FIG. 9C, the electrically insulating layer 2*e* has an opening in which the first magnetic yoke 2*b* will be formed later.

The electrically insulating layer 2*e* includes photoresist having been baked at 250 degrees centigrade. The electrically insulating layer 2*e* may be comprised of an alumina film or a silicon dioxide film formed by sputtering as well as photoresist.

Then, the thin-film coil 2*c* is formed on the electrically insulating layer 2*e* (FIG. 9C).

The thin-film coil 2*c* is formed by forming a photoresist mask having a coil-shaped opening, and growing copper (Cu) in the opening by electro-plating to thereby have a coil having a desired shape.

Then, on the electrically insulating layer 2*e* is formed an electrically insulating layer 2*f* such that the electrically insulating layer 2*f* covers the thin-film coil 2*c* therewith (FIG. 9C). The electrically insulating layer 2*f* insulates the thin-film coil 2*c* from others and protects the thin-film coil 2*c*.

The electrically insulating layer 2*f* includes a photoresist having been baked at 250 degrees centigrade. The electrically insulating layer 2*f* may be comprised of an alumina film or a silicon dioxide film formed by sputtering as well as photoresist.

Then, the first magnetic yokes 2*b* are formed on the second magnetic yokes 2*a* (FIG. 9D).

The first magnetic yokes 2*b* have a thickness of 20 micrometers, and are composed of Ni—Fe alloy. The first magnetic yokes 2*b* can be fabricated by electro-plating.

The first magnetic yokes 2*b* may be composed of any material, if it provides high saturation magnetization and has high magnetic permeability. The first magnetic yoke 2*b* may be composed of, for instance, microcrystal alloy containing Fe, such as Co—Ni—Fe alloy or Fe—Ta—N, amorphous alloy containing Co, such as Co—Ta—Zr, or soft iron.

A film of which the first magnetic yoke 2*b* is comprised can be formed by sputtering or evaporation as well as electro-plating.

A film of which the first magnetic yoke 2*b* is comprised has a thickness preferably in the range of 0.1 micrometer to 200 micrometers, and more preferably in the range of 1 micrometer to 50 micrometers.

Then, the resultant is entirely covered with an alumina film 1*b* formed by sputtering (FIG. 9E).

Then, the alumina film 1*b* is polished for planarization such that the first magnetic yoke 2*b* acting as magnetic pole is exposed to a planarized surface of the alumina film 1*b* (FIG. 9F).

Thus, there is completed a thin-film electromagnet unit 1 including the first and second thin-film electromagnets 10*a* and 10*b*.

Since the first magnetic yoke 2*b* acting as magnetic pole is exposed to a surface of the sputtered film 1*b* in the thin-film electromagnet unit 1, and the sputtered film 1*b* is planarized, it is possible to form other unit(s) on the thin-film electromagnet unit 1 without any preparation.

Fabrication of an electromagnet through a thin-film fabrication process makes it possible to fabricate a plurality of electromagnets in desired arrangement on a large-size wafer, and further, to fabricate a tiny electromagnet which was not able to be fabricated by means of conventional machines.

Hereinbelow are explained steps of fabricating the first and second electrical contacts and the swingable unit 3 on the thin-film electromagnet unit 1 having been fabricated by the above-mentioned steps.

The insulating layers 6*a* and 6*b* are formed on the alumina film 1*b* in which the first and second thin-film electromagnets 10*a* and 10*b* are buried, for electrically insulating a magnetic pole plane (FIG. 9G).

The insulating layers 6*a* and 6*b* are comprised of an alumina film formed by sputtering. The insulating layers 6*a* and 6*b* can be formed into a desired shape by ion-beam etching through the use of a photoresist mask. The insulating layers 6*a* and 6*b* may be omitted, if they are not necessary.

Then, the first electrical contacts 4*a* and 4*b* are formed on the insulating layers 6*a* and 6*b*, respectively (FIG. 9H).

The first electrical contacts 4*a* and 4*b* are composed of platinum and formed by sputtering. The first electrical contacts 4*a* and 4*b* can be formed into a desired shape by ion-beam etching through the use of a photoresist mask. The first electrical contacts 4*a* and 4*b* may be composed of metal containing at least one of platinum, rhodium, palladium, gold and ruthenium, as well as platinum.

Then, there is formed a sacrificial layer 11 for preparation of formation of the swingable unit 3 (FIG. 9I).

The sacrificial layer 11 is formed by electro-plating in an area other than an area in which the later mentioned pillars 3*b* are formed. The sacrificial layer 11 includes a Cu film having a thickness of 50 micrometers.

Another sacrificial layer is formed in an area in which the Cu electro-plated film is not formed, such as an area in which the pillars 3*c* are formed, by in advance forming a photoresist pattern. The sacrificial layer has a thickness in the range of about 0.05 micrometers to about 500 micrometers both inclusive. The sacrificial layer may be composed of photoresist.

Next, the pillars 3*b* are formed (FIG. 9J).

A gold-plating film as the pillars 3*b* is buried into the sacrificial layer 11.

Then, on the sacrificial layer 11 are formed the springs 3*c* and the second electrical contacts 5*a* and 5*b* (FIG. 9K).

The springs 3*c* are formed by depositing spring material by sputtering, and patterning the spring material by means of a photoresist mask. The springs 3*c* may be formed by first forming a photoresist mask, depositing spring material by sputtering, and lifting off.

As the spring material is used CoTaZrCr amorphous alloy. The use of amorphous metal accomplishes highly reliable, long-life springs 3*c*, because amorphous metal does not contain grain boundary, and hence, metal fatigue caused by grains does not theoretically occur.

As the spring material, there may be selected amorphous metal predominantly containing Ta and/or W, or shape memory metal such as Ni—Ti alloy. As an alternative, phosphor bronze, beryllium copper or aluminum alloy each having various compositions may be selected.

An advantage of the use of shape memory metal is that the springs 3*c* can keep its original shape, even if repeatedly deformed. The spring materials may be selected in accordance with purposes.

Then, the second electrical contacts 5*a* and 5*b* are formed by forming a photoresist mask on the sacrificial layer 11, depositing metal by sputtering, and lifting off (FIG. 9K).

The second electrical contacts 5*a* and 5*b* are comprised of a platinum film formed by sputtering. The second electrical contacts 5*a* and 5*b* may be composed of metal containing at least one of platinum, rhodium, palladium, gold and ruthenium, as well as platinum.

Then, a planarized layer 12 is formed for planarizing steps formed by the springs 3*c* and the second electrical contacts 5*a* and 5*b* (FIG. 9L).

The planarized layer 12 is formed by forming a photoresist mask on the springs 3*c* and the second electrical contacts 5*a* and 5*b*, and lifting off the copper film by ion-beam sputtering having high directivity.

The planarized layer 12 may be formed by coating a photoresist film, and removing the photoresist film in an area in which the springs 3*c* and the second electrical contacts 5*a* and 5*b* are to be fabricated.

The planarized layer 12 will be removed together with the sacrificial layer 11.

Then, the swinger 3*a* is fabricated as follows (FIG. 9M).

The swinger 3*a* is fabricated by depositing a material of which the swinger 3*a* is composed, by sputtering, and patterning the material through the use of a photoresist mask.

As an alternative, the swinger 3*a* may be fabricated by fabricating a photoresist mask, depositing a swinger material by sputtering, and lifting off the material.

The swinger 3*a* has a thickness preferably in the range of 0.1 micrometer to 100 micrometers, and more preferably in the range of 0.5 micrometers to 10 micrometers. In the seventh embodiment, the swinger 3*a* is designed to have a thickness of 1 micrometer.

The swinger 3*a* is composed of the above-mentioned materials. The swinger 3*a* composed of magnetic substance readily producing residual magnetization is magnetized in a left-right direction in FIG. 9M. For instance, the swinger 3*a* is magnetized such that the swinger 3*a* has N-polarity at its left side and S-polarity at its right side.

Then, the sacrificial layer 11 and the planarized layer 12 are removed (FIG. 9N).

When the sacrificial layer 11 and the planarized layer 12 are composed of copper, the sacrificial layer 11 and the planarized layer 12 are removed by chemical etching.

When the sacrificial layer 11 and the planarized layer 12 are composed of photoresist, they can be removed by oxygen ashing.

By carrying out the above-mentioned steps, the switching device in accordance with the seventh embodiment, illustrated in FIG. 8, is completed.

Eighth Embodiment

Figure 10A:
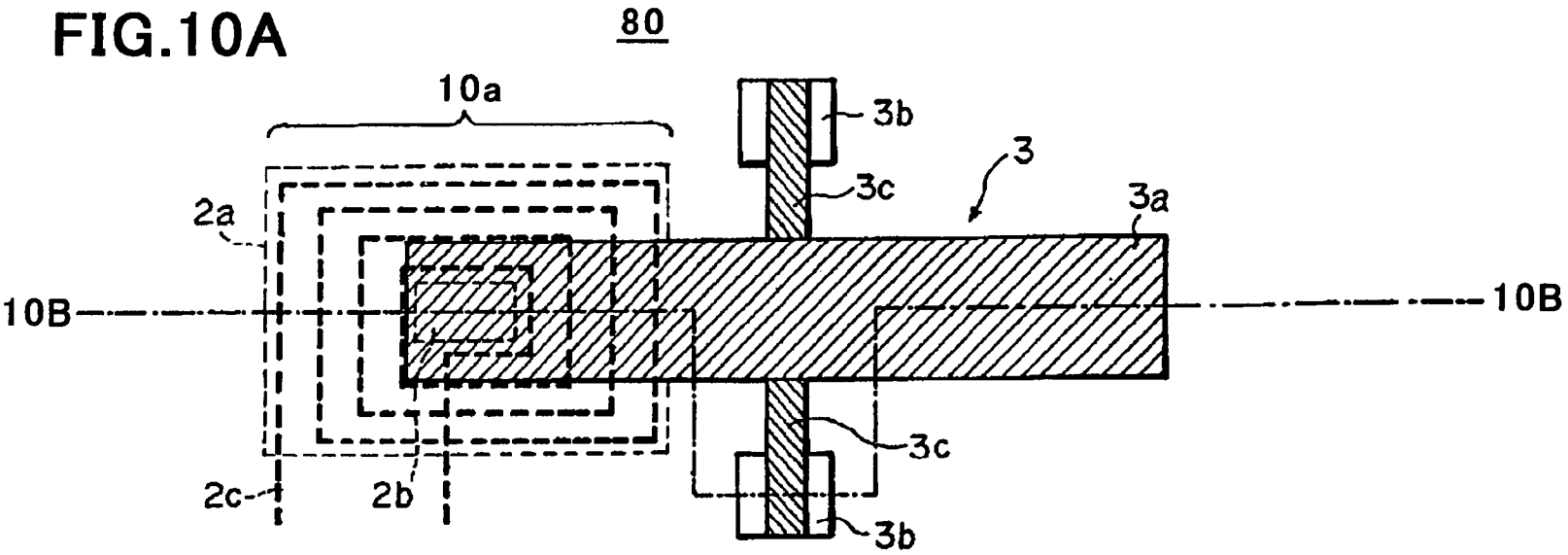
FIG. 10A is a plan view of a switching device in accordance with the eighth embodiment of the present invention.
Figure 10B:
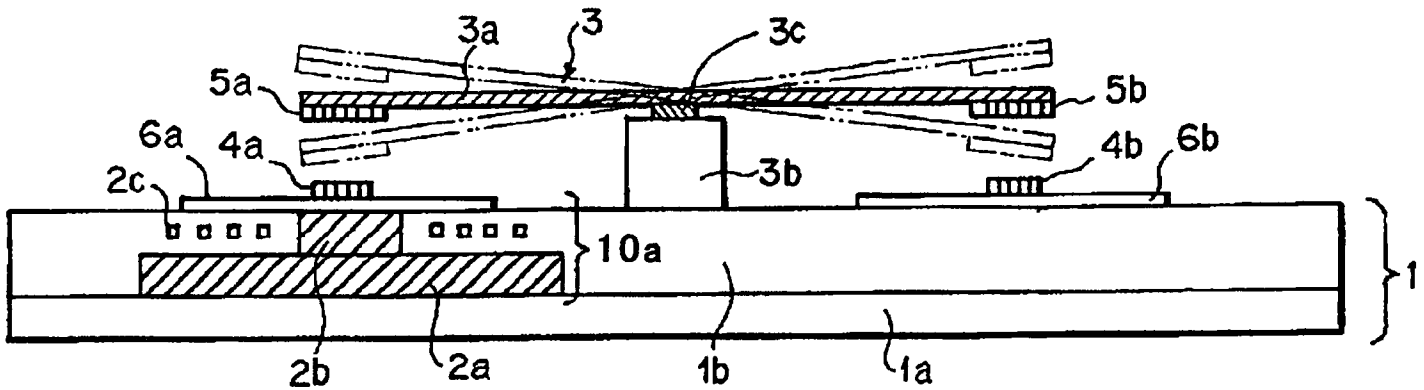
FIG. 10B is a cross-sectional view taken along the line 10B—10B in FIG. 10A.

FIGS. 10A and 10B illustrate a switching device 80 in accordance with the eighth embodiment of the present invention. FIG. 10A is an upper plan view of the switching device 80, and FIG. 10B is a cross-sectional view taken along the line 10B—10B in FIG. 10A.

Though in the switching device 70 in accordance with the seventh embodiment, illustrated in FIGS. 8A and 8B, the thin-film electromagnet unit 1 is designed to include two thin-film electromagnets, that is, the first and second thin-film electromagnets 10*a* and 10*b*, the switching device 80 in accordance with the eighth embodiment is designed to include only the first thin-film electromagnet 10*a*, and not to include the second thin-film electromagnet 10*b*. The switching device 80 in accordance with the eighth embodiment has the same structure as that of the switching device 70 in accordance with the seventh embodiment except not including the second thin-film electromagnet 10*b*.

In the switching device 80 in accordance with the eighth embodiment, by flowing a current through the thin-film coil 2*c* of the first thin-film electromagnet 10*a*, magnetic flux is generated at the first magnetic yoke 2*b*, and hence, the swinger 3*a* is attracted to the first magnetic yoke 2*b*. That is, the swinger 3*a* rotates about the springs 3*c* in a counterclockwise direction. Thus, the second electrical contact 5*a* makes contact with the first electrical contact 4*a*, thereby turning on a switch.

By interrupting a current running through the thin-film coil 2*c*, the magnetic flux having been generated at the first magnetic yoke 2*b* vanishes. Hence, the swinger 3*a* having been attracted to the first magnetic yoke 2*b* is separated from the first magnetic yoke 2*b* by repulsive force of the springs 3*c*. As a result, the second electrical contact 5*a* makes contact with the first electrical contact 4*a*, thereby a switch being turned off.

The switching device 80 in accordance with the eighth embodiment operates as follows.

The swinger 3*a* is magnetized such that its left side has N-polarity and its right side has S-polarity, for instance.

The first thin-film electromagnet 10*a* is made to operate such that the first magnetic yoke 2*b* provides N- or S-polarity at a surface thereof. Thus, if the first magnetic yoke 2*b* provides S-polarity at a surface thereof, attractive force is generated between the first magnetic yoke 2*b* and a left end of the swinger 3*a*. As a result, the swinger 3*a* rotates about the springs 3*c* in a counterclockwise direction. Thus, the second electrical contact 5*a* makes contact with the first electrical contact 4*a*, and the second electrical contact 5*b* and the first electrical contact 4*a* are separated from each other.

Even if a coil current is interrupted in such a condition, attractive force is kept generated due to the residual magnetization of the swinger 3*a* between the pole (S-polarity) of the first magnetic yoke 2*b* of the first thin-film electromagnet 10*a* and the left end (N-polarity) of the swinger 3*a*, and thus, the swinger 3*a* receives force which causes the swinger 3*a* to rotate in a counterclockwise direction, and the second electrical contact 5*a* is kept in contact with the first electrical contact 4*a*.

If the first magnetic yoke 2*b* is turned at a surface thereof into N-polarity, repulsive force is generated between the first magnetic yoke 2*b* and the swinger 3*a*. As a result, the swinger 3*a* rotates about the springs 3*c* in a clockwise direction. Thus, the second electrical contact 5*a* is disconnected from the first electrical contact 4*a*, and the second electrical contact 5*b* makes contact with the first electrical contact 4*b*.

Ninth Embodiment

Figure 11A:
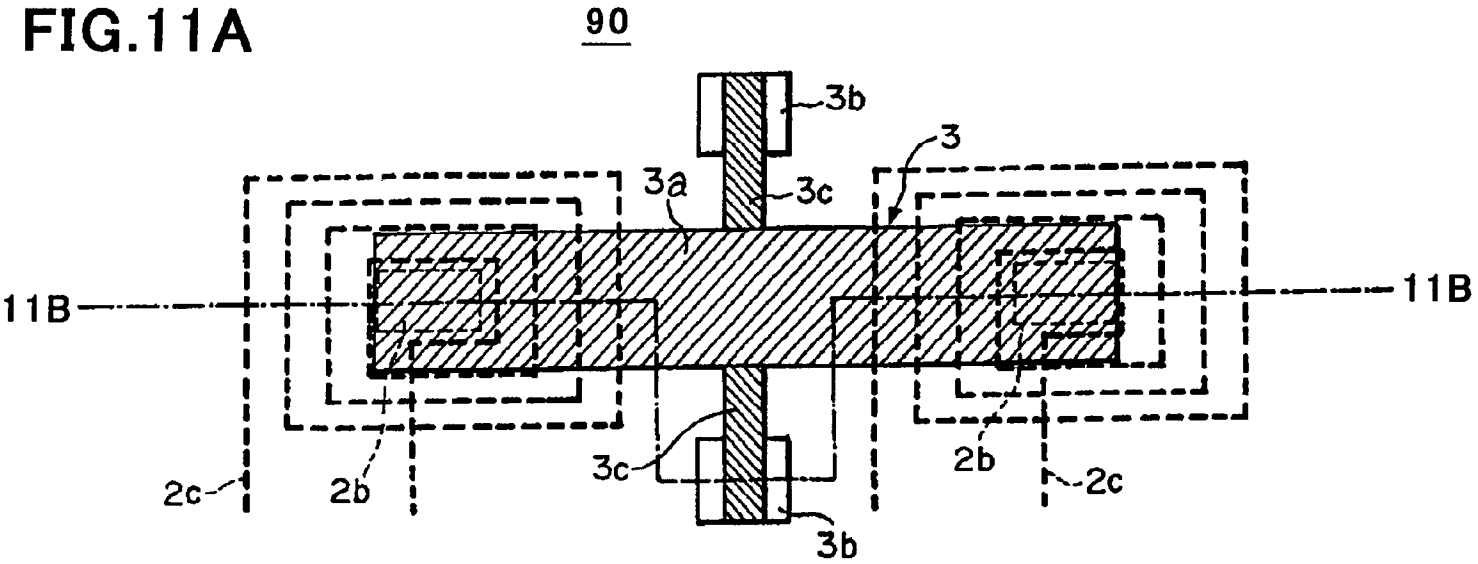
FIG. 11A is a plan view of a switching device in accordance with the ninth embodiment of the present invention.
Figure 11B:
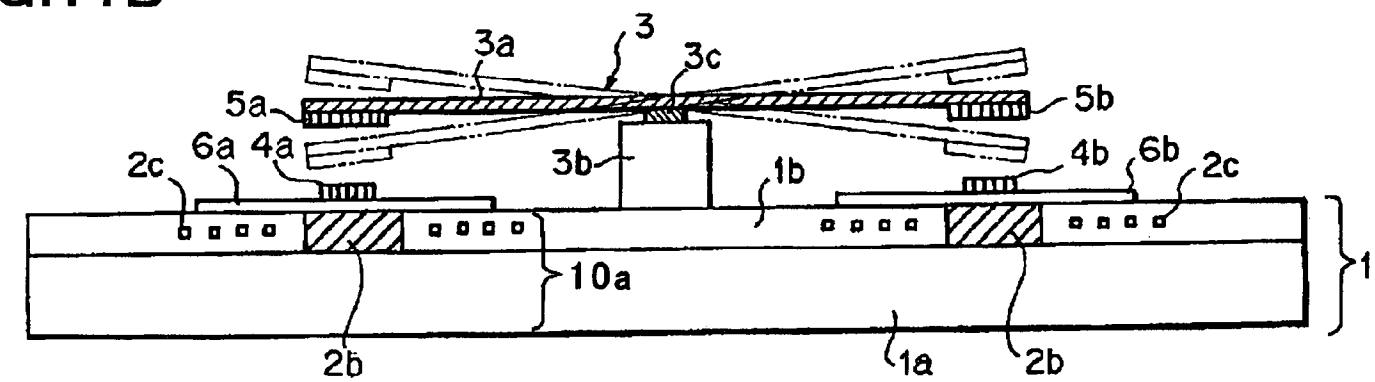
FIG. 11B is a cross-sectional view taken along the line 11B—11B in FIG. 11A.

FIGS. 11A and 11B illustrate a switching device 90 in accordance with the ninth embodiment of the present invention. FIG. 11A is an upper plan view of the switching device 90, and FIG. 11B is a cross-sectional view taken along the line 11B—11B in FIG. 11A.

Though in the switching device 70 in accordance with the seventh embodiment, illustrated in FIGS. 8A and 8B, each of the first and second thin-film electromagnets 10*a* and 10*b* includes the thin-film electromagnet 10 in accordance with the first embodiment, illustrated in FIGS. 1A and 1B, a thin-film electromagnet constituting the first and second thin-film electromagnets 10*a* and 10*b* is not to be limited to the thin-film electromagnet 10 in accordance with the first embodiment.

As illustrated in FIGS. 11A and 11B, the thin-film electromagnet 40 in accordance with the fourth embodiment, illustrated in FIGS. 4A and 4B, may be used as the first and second thin-film electromagnets 10*a* and 10*b*.

The switching device 90 in accordance with the ninth embodiment operates in the same way as the switching device 70 in accordance with the seventh embodiment, illustrated in FIGS. 8A and 8B, and provides the same advantages as those provided by the switching device 70.

Tenth Embodiment

Figure 12A:
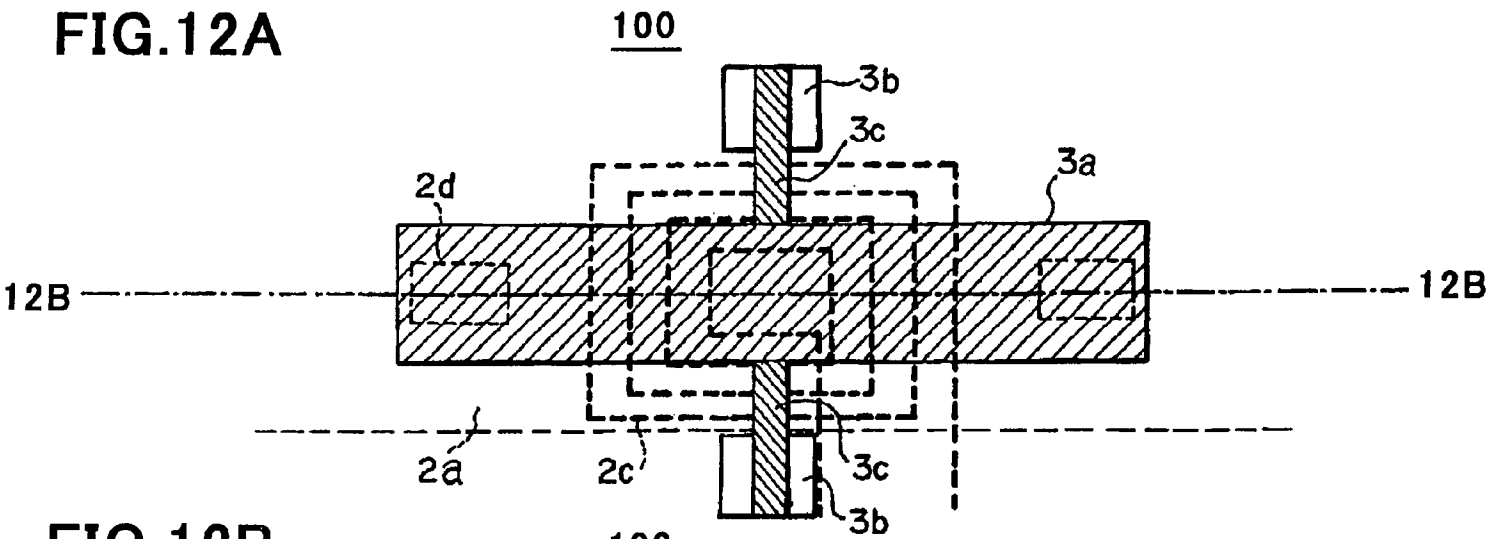
FIG. 12A is a plan view of a switching device in accordance with the tenth embodiment of the present invention.
Figure 12B:
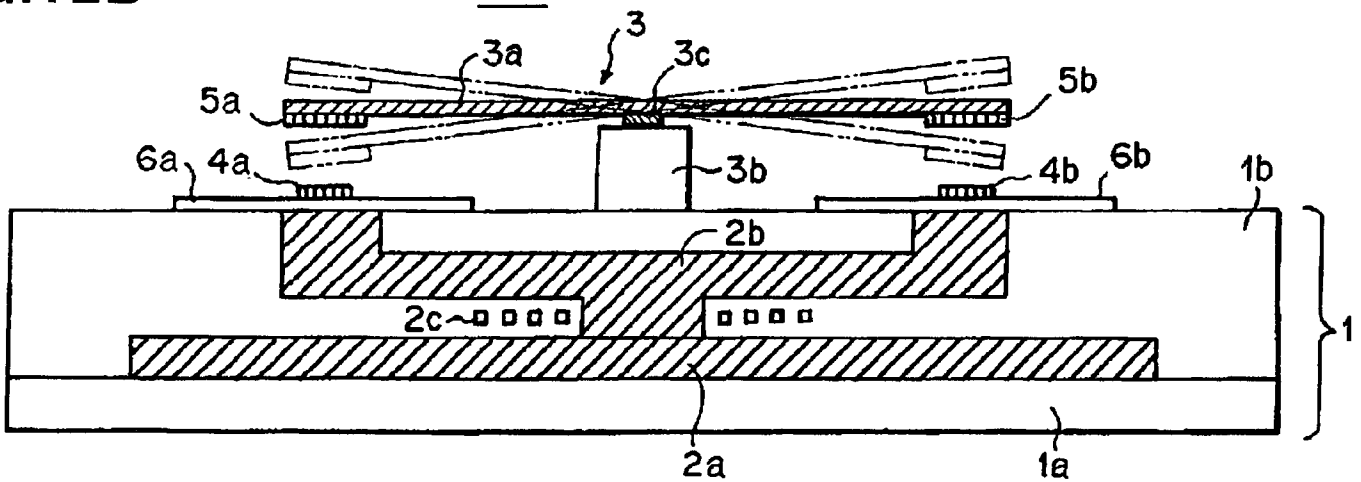
FIG. 12B is a cross-sectional view taken along the line 12B—12B in FIG. 12A.

FIGS. 12A and 12B illustrate a switching device 100 in accordance with the tenth embodiment of the present invention. FIG. 12A is an upper plan view of the switching device 100, and FIG. 12B is a cross-sectional view taken along the line 12B—12B in FIG. 12A.

Though in the switching device 70 in accordance with the seventh embodiment, illustrated in FIGS. 8A and 8B, each of the first and second thin-film electromagnets 10*a* and 10*b* includes the thin-film electromagnet 10 in accordance with the first embodiment, illustrated in FIGS. 1A and 1B, a thin-film electromagnet constituting the first and second thin-film electromagnets 10*a* and 10*b* is not to be limited to the thin-film electromagnet 10 in accordance with the first embodiment.

As illustrated in FIGS. 12A and 12B, the thin-film electromagnet 60 in accordance with the sixth embodiment, illustrated in FIGS. 7A and 7B, may be used as the first and second thin-film electromagnets 10*a* and 10*b*.

The switching device 100 in accordance with the tenth embodiment operates in the same way as the switching device 70 in accordance with the seventh embodiment, illustrated in FIGS. 8A and 8B, and provides the same advantages as those provided by the switching device 70.

Eleventh Embodiment

Figure 13A:
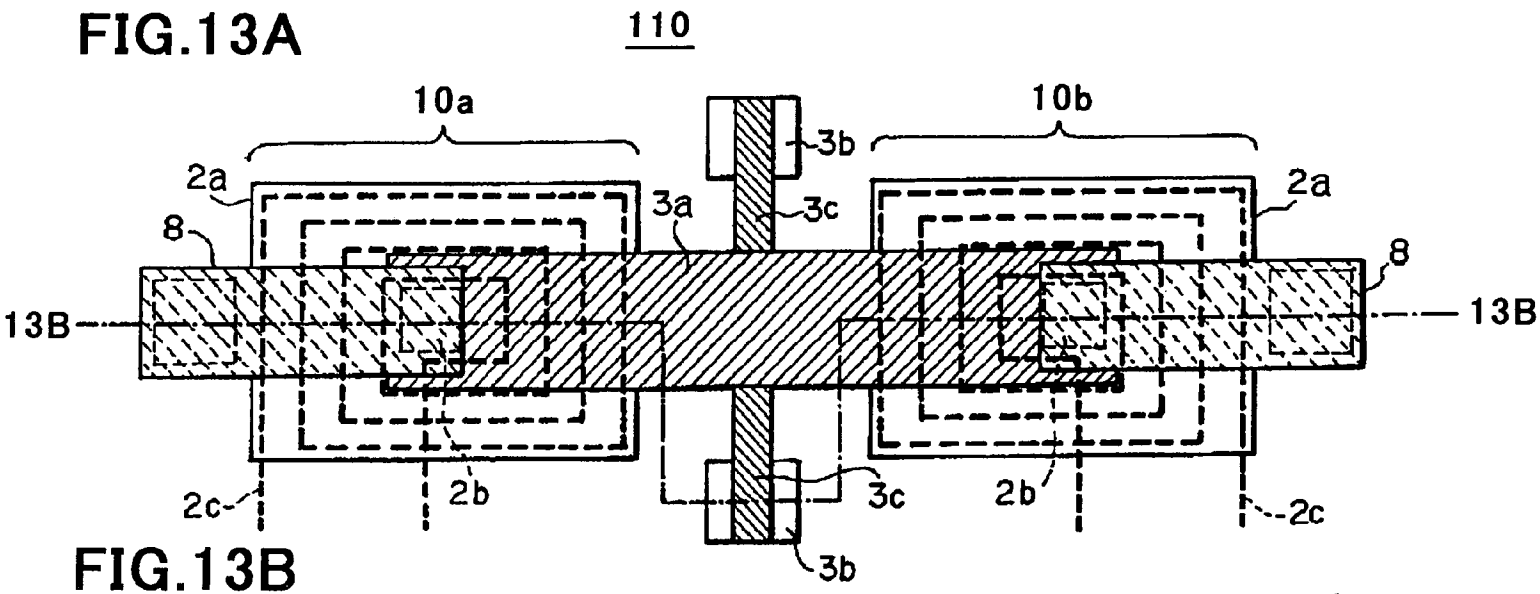
FIG. 13A is a plan view of a switching device in accordance with the eleventh embodiment of the present invention.
Figure 13B:
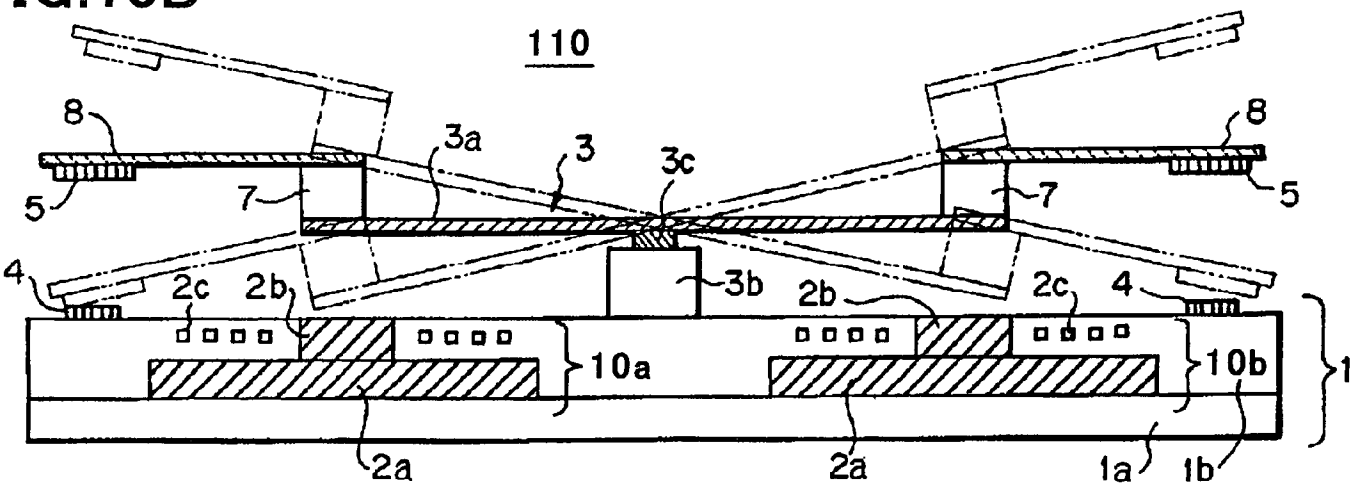
FIG. 13B is a cross-sectional view taken along the line 13B—13B in FIG. 13A.

FIGS. 13A and 13B illustrate a switching device 110 in accordance with the eleventh embodiment of the present invention. FIG. 13A is an upper plan view of the switching device 110, and FIG. 13B is a cross-sectional view taken along the line 13B—13B in FIG. 13A.

In comparison with the switching device 70 in accordance with the seventh embodiment, illustrated in FIGS. 8A and 8B, the switching device 110 in accordance with the eleventh embodiment is designed to further include a pair of connectors 7 formed on the swinger 3*a* at its opposite ends, and a pair of extensions 8 fixed to the swinger 3*a* through the connectors 7.

The extensions 8 extend in the same direction as a direction in which the swinger 3*a* extends, and then, an entire length of the swinger 3*a* is extended by a length of the extensions 8.

The connectors 7 are composed of metal such as Ta or insulator such as alumina. The extensions 8 are composed of metal such as Ta or insulator such as alumina.

The second electrical contacts 5*a* and 5*b* are mounted on a lower surface of the extensions 8 at distal ends of the extensions 8. In association with locations of the second electrical contacts 5*a* and 5*b*, the first electrical contacts 4*a* and 4*b* are outwardly deviated from locations of the first electrical contacts 4*a* and 4*b* in the switching device 70 in accordance with the seventh embodiment, that is, locations above the first and second thin-film electromagnets 10*a* and 10*b*. Since the first electrical contacts 4*a* and 4*b* are outwardly deviated from locations above the first and second thin-film electromagnets 10*a* and 10*b*, the switching device 110 in accordance with the eleventh embodiment is designed not to include the insulating layers 6*a* and 6*b*.

As explained above, the switching device 110 in accordance with the eleventh embodiment has the same structure as that of the switching device 70 in accordance with the seventh embodiment, illustrated in FIGS. 8A and 8B, except that the switching device 110 further includes the connectors 7 and the extensions 8, the first electrical contacts 4*a*, 4*b* and the second electrical contacts 5*a*, 5*b* are positioned in different locations, and the switching device 110 does not include the insulating layers 6*a* and 6*b*.

The switching device 110 in accordance with the eleventh embodiment operates in the same way as the switching device 70 in accordance with the seventh embodiment, illustrated in FIGS. 8A and 8B, and provides the same advantages as those provided by the switching device 70.

Though in the switching device 110 in accordance with the eleventh embodiment, illustrated in FIGS. 13A and 13B, each of the first and second thin-film electromagnets 10*a* and 10*b* includes the thin-film electromagnet 10 in accordance with the first embodiment, illustrated in FIGS. 1A and 1B, a thin-film electromagnet constituting the first and second thin-film electromagnets 10*a* and 10*b* is not to be limited to the thin-film electromagnet 10 in accordance with the first embodiment. Any one of the thin-film electromagnets in accordance with the second to sixth embodiments may be used as the first and second thin-film electromagnets 10*a* and 10*b*.

Twelfth Embodiment

Figures 14A, 14B:
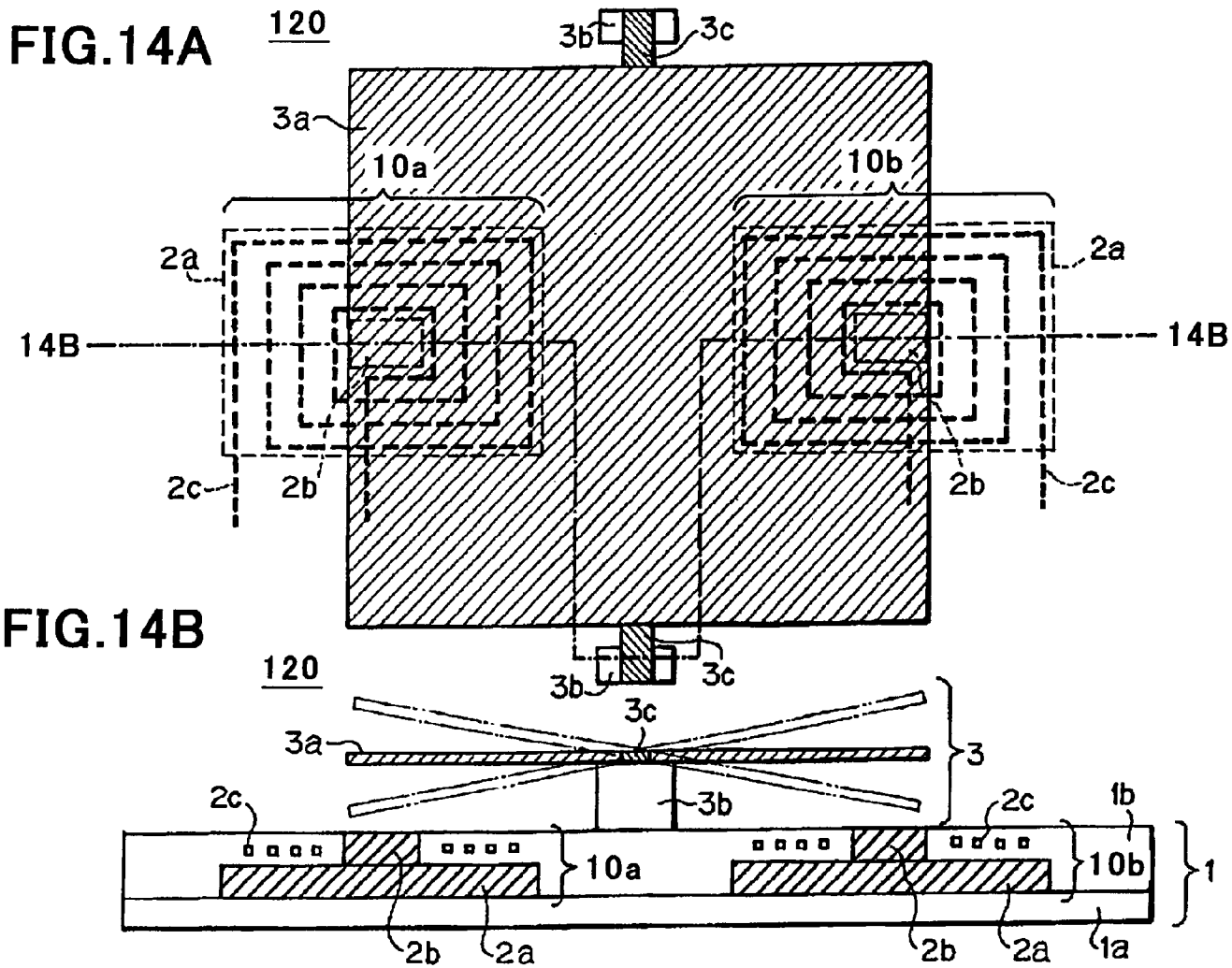
FIG. 14A is a plan view of a switching device in accordance with the twelfth embodiment of the present invention.
FIG. 14B is a cross-sectional view taken along the line 14B—14B in FIG. 14A.

FIGS. 14A and 14B illustrate a switching device 120 in accordance with the twelfth embodiment of the present invention. FIG. 14A is an upper plan view of the switching device 120, and FIG. 14B is a cross-sectional view taken along the line 14B—14B in FIG. 14A.

As mentioned below, the switching device 120 in accordance with the twelfth embodiment is constructed as an optical switch.

The switching device 120 in accordance with the twelfth embodiment is structurally different from the switching device 70 in accordance with the seventh embodiment, illustrated in FIGS. 8A and 8B, as follows.

First, the swinger 3*a* in the switching device 120 in accordance with the twelfth embodiment is coated at a surface thereof with a material suitable for reflecting light. Specifically, the swinger 3*a* is coated with a thin gold or silver film over its entire surface or in at least regions in which light is irradiated. Such a thin gold or silver film can be formed by sputtering or evaporation.

Second, since the switching device 120 in accordance with the twelfth embodiment is constructed as an optical switch, it is not necessary for the switching device 120 to include an electrical contact. Hence, the switching device 120 in accordance with the twelfth embodiment is designed not to include the first electrical contacts 4*a* and 4*b*, the second electrical contacts 5*a* and 5*b*, and the insulating layers 6*a* and 6*b* which were included in the switching device 70 in accordance with the seventh embodiment.

The switching device 120 in accordance with the twelfth embodiment operates in the same way as the switching device 70 in accordance with the seventh embodiment.

For instance, the swinger 3*a* is magnetized to N-polarity at its left side and S-polarity at its right side in a left-right direction of FIG. 14A, and the first and second thin-film electromagnets 10*a* and 10*b* are alternately driven such that the first magnetic yokes 2*b* of them are magnetized to N- and S-polarities, respectively. As a result, repulsive force is generated between the swinger 3*a* and the first magnetic yokes 2*b* of the first and second thin-film electromagnets 10*a* and 10*b*. Thus, there can be accomplished analogue control which provides a stable, big swing angle of the swinger 3*a*.

Specifically, when attractive force is generated between the poles, the force would suddenly increase, if a gap between the poles is narrowed to some degree, resulting in inability in angle-control of the swinger 3*a*. In contrast, the use of repulsive force between the poles can solve the problem.

It is assumed that a current to the thin-film 2*c* is interrupted.

Even if such a current is interrupted, the swinger 3*a* is supported by the springs 3*c* and is kept horizontal. Then, a current is supplied to the thin-film coil 2*c* such that an upper surface of the first magnetic yoke 2*b* of the first thin-film electromagnet 10*a* acts as N-pole. As a result, repulsive force is generated between the first magnetic yoke 2*b* and the left end of the swinger 3*a*, and thus, the swinger 3*a* rotates in a clockwise direction. The swinger 3*a* is inclined at maximum such that the right end of the swinger 3*a* makes contact with an upper surface of the first magnetic yoke 2*b* of the second thin-film electromagnet 10*b*. At this time, the right end of the swinger 3*a* acts as S-pole, and hence, if the right end of the swinger 3*a* approaches an upper surface of the first magnetic yoke 2*b* of the second thin-film electromagnet 10*b*, attractive force therebetween is increased.

Hence, in order to prevent magnetic pole from generating at an upper surface of the first magnetic yoke 2*b* of the second thin-film electromagnet 10*b* to thereby cancel the thus increased attractive force, a current running through the thin-film coil 2*c* is controlled. Thus, it is possible to carry out analogue control until the right end of the swinger 3*a* makes contact with an upper surface of the first magnetic yoke 2*b* of the second thin-film electromagnet 10*b*.

In contrast, if a current is supplied to the thin-film coil 2*c* such that an upper surface of the first magnetic yoke 2*b* of the second thin-film electromagnet 10*b* acts as N-pole, repulsive force is generated between the first magnetic yoke 2*b* of the second thin-film electromagnet 10*b* and the right end of the swinger 3*a*, and thus, the swinger 3*a* rotates in a counterclockwise direction. The swinger 3*a* is inclined at maximum such that the left end of the swinger 3*a* makes contact with an upper surface of the first magnetic yoke 2*b* of the first thin-film electromagnet 10*a*. At this time, the left end of the swinger 3*a* acts as N-pole, and hence, if the left end of the swinger 3*a* approaches an upper surface of the first magnetic yoke 2*b* of the first thin-film electromagnet 10*a*, attractive force therebetween is increased.

Hence, in order to prevent magnetic pole from generating at an upper surface of the first magnetic yoke 2*b* of the first thin-film electromagnet 10*a* to thereby cancel the thus increased attractive force, a current running through the thin-film coil 2*c* is controlled. Thus, it is possible to carry out analogue control until the left end of the swinger 3*a* makes contact with an upper surface of the first magnetic yoke 2*b* of the first thin-film electromagnet 10*a*.

In accordance with the above-mentioned operation, it is possible to accomplish an optical analog-controlled switch providing a big swing angle.

As explained above, the switching device 120 in accordance with the twelfth embodiment makes it possible to control an inclination angle of the swinger 3*a* by controlling a current running through each of the thin-film coils 2*c* of the first and second thin-film electromagnets 10*a* and 10*b*. Thus, an optical switch which can be controlled in an analog manner is accomplished.

In the switching device 120 in accordance with the twelfth embodiment, illustrated in FIGS. 14A and 14B, each of the first and second thin-film electromagnets 10*a* and 10*b* includes the thin-film electromagnet 10 in accordance with the first embodiment, illustrated in FIGS. 1A and 1B, but a thin-film electromagnet constituting the first and second thin-film electromagnets 10*a* and 10*b* is not to be limited to the thin-film electromagnet 10 in accordance with the first embodiment. Any one of the thin-film electromagnets in accordance with the second to sixth embodiments may be used as the first and second thin-film electromagnets 10*a* and 10*b*.

Thirteenth Embodiment

Figure 15A:
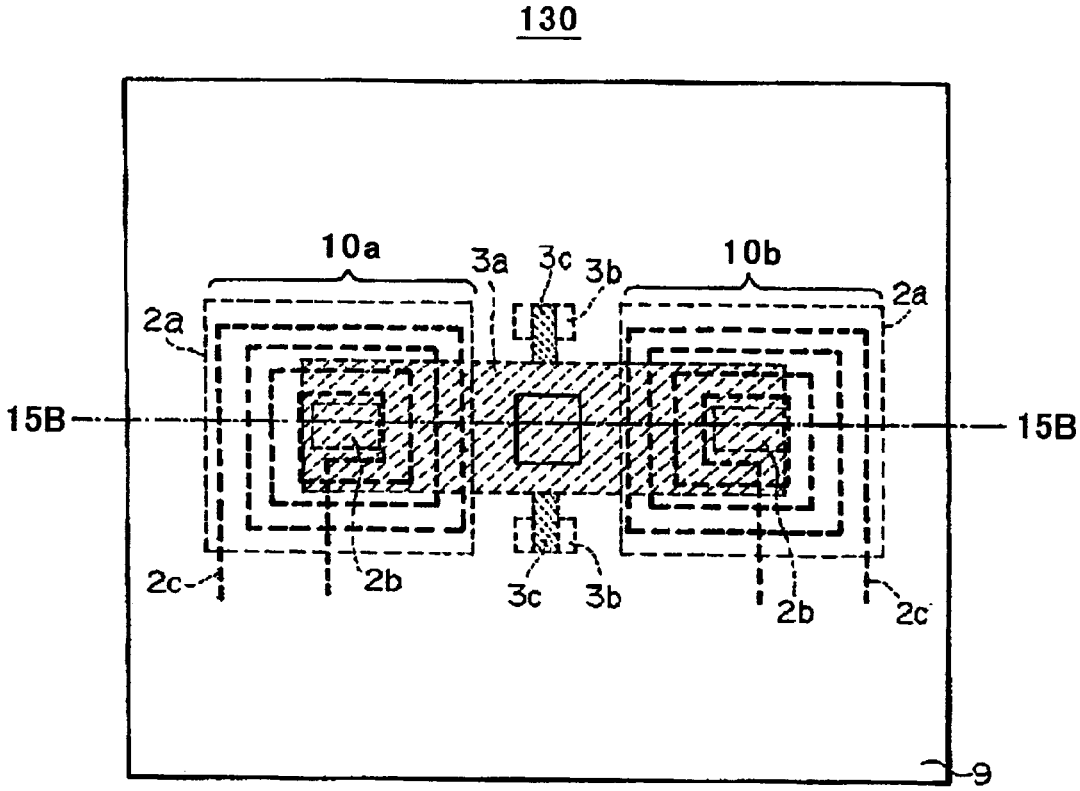
FIG. 15A is a plan view of a switching device in accordance with the thirteenth embodiment of the present invention.
Figure 15B:
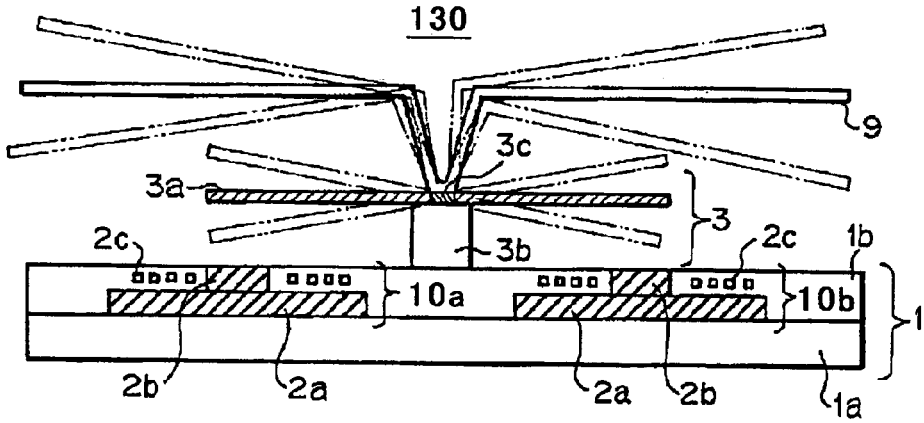
FIG. 15B is a cross-sectional view taken along the line 15B—15B in FIG. 15A.

FIGS. 15A and 15B illustrate a switching device 130 in accordance with the thirteenth embodiment of the present invention. FIG. 15A is an upper plan view of the switching device 130, and FIG. 15B is a cross-sectional view taken along the line 15B—15B in FIG. 15A.

Similarly to the switching device 120 in accordance with the twelfth embodiment, illustrated in FIG. 14, the switching device 130 in accordance with the thirteenth embodiment is constructed as an optical switch.

The switching device 130 in accordance with the thirteenth embodiment is structurally different from the switching device 120 in accordance with the twelfth embodiment only in further including a mirror unit 9 formed on an upper surface of the swinger 3*a* for reflecting light.

The mirror unit 9 is fixed on the swinger 3*a* and is designed to entirely cover the swinger 3*a* therewith.

Since the switching device 130 in accordance with the thirteenth embodiment is designed to include the mirror unit 9, a thin gold or silver film is not coated over a surface of the swinger 3*a*.

The mirror unit 9 can be fabricated by forming a sacrificial layer, depositing metal or insulator of which the mirror unit 9 is composed, on the sacrificial layer by sputtering, patterning the metal or insulator into the mirror unit, and removing the sacrificial layer.

The switching device 130 in accordance with the thirteenth embodiment operates in the same way as the switching device 120 in accordance with the twelfth embodiment, illustrated in FIGS. 14A and 14B, and provides the same advantages as those provided by the switching device 120.

Fourteenth Embodiment

Figure 16A:
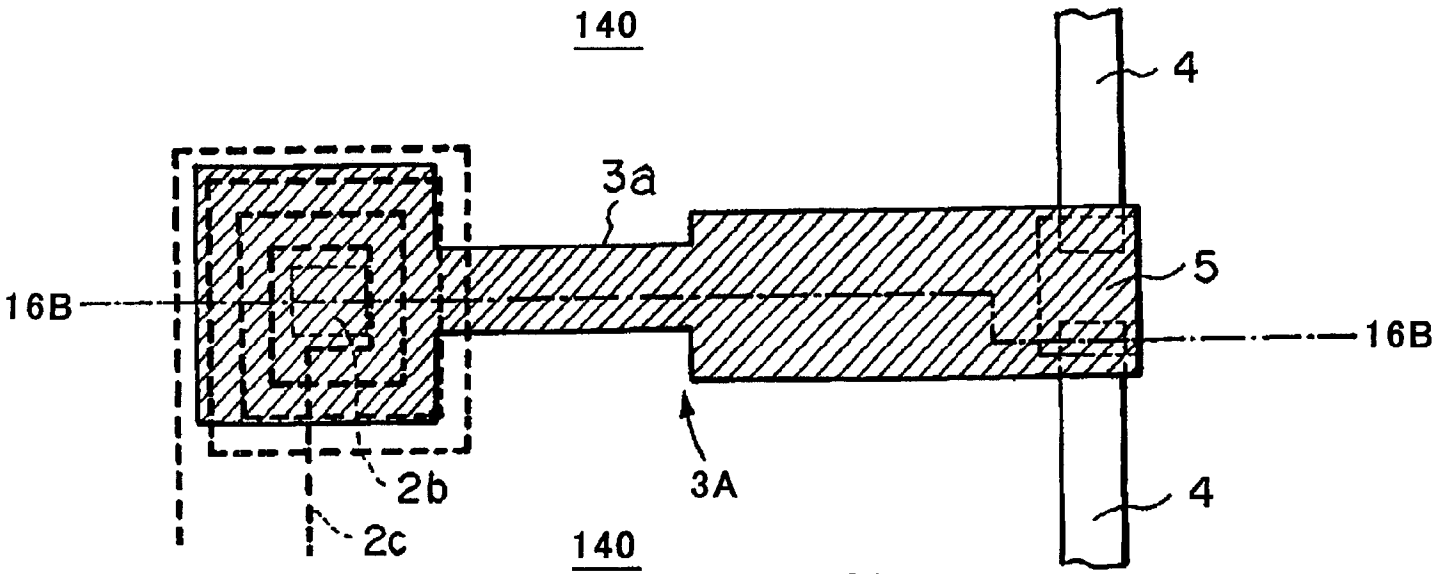
FIG. 16A is a plan view of a switching device in accordance with the fourteenth embodiment of the present invention.
Figure 16B:
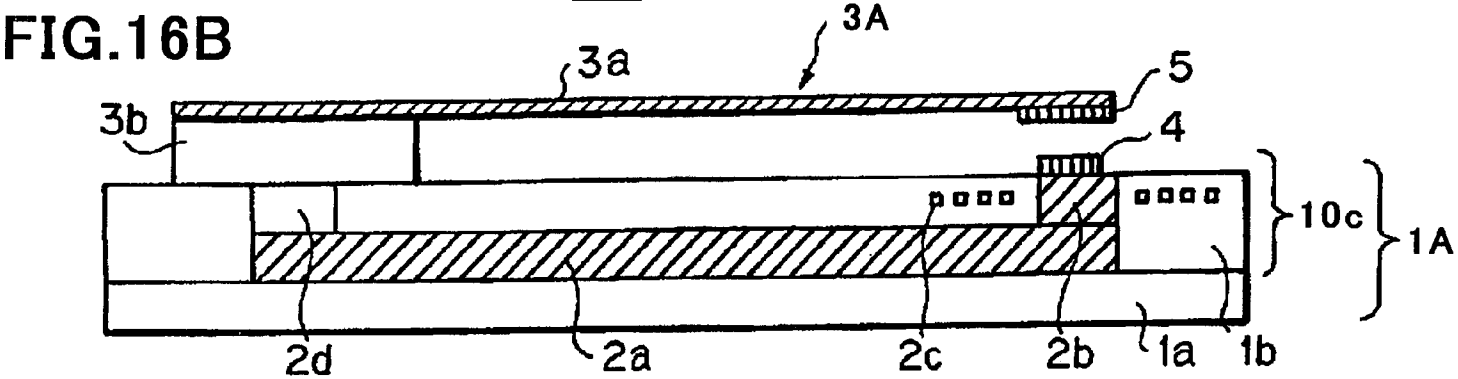
FIG. 16B is a cross-sectional view taken along the line 16B—16B in FIG. 16A.

FIGS. 16A and 16B illustrate a switching device 140 in accordance with the fourteenth embodiment of the present invention. FIG. 16A is an upper plan view of the switching device 140, and FIG. 16B is a cross-sectional view taken along the line 16B—16B in FIG. 16A.

The switching device 140 in accordance with the fourteenth embodiment includes a thin-film electromagnet 1A, and a swingable unit 3A formed on the thin-film electromagnet 1A.

The thin-film electromagnet 1A includes a substrate 1*a*, a thin-film electromagnet 10*c* formed on the substrate 1*a*, a protection layer 1*b* formed on the substrate 1*a* to cover the thin-film electromagnet 10*c* therewith such that the first magnetic yoke 2*b* of the thin-film electromagnet 10*c* is exposed, and having a planarized surface, and a first electrical contact 4 formed on the first magnetic yoke 2*b*.

The thin-film electromagnet 10*c* has the same structure as that of the thin-film electromagnet 20 in accordance with the second embodiment, illustrated in FIGS. 3A and 3B.

The swingable unit 3A includes a pillar 3*b* formed away from the first magnetic yoke 2*b* of the thin-film electromagnet 10*c* by a predetermined distance, a swinger 3*a* comprised of a cantilever supported at its one end on the pillar 3*b*, and a second electrical contact 5 formed on a lower surface of the swinger 3*a* at a distal end of the swinger 3*a*.

The swinger 3*a* comprised of a cantilever faces the first electrical contact 4 at a free end thereof. Hence, the second electrical contact 5 and the first electrical contact 4 face each other.

The pillar 3*b* and the second magnetic yoke 2*a* are connected to each other through a connector 2*d*.

The swinger 3*a* is composed of magnetic substance. Hence, electromagnetic force is generated between the swinger 3*a* and an upper surface of the first magnetic yoke 2*b* acting as a magnetic pole of the thin-film electromagnet 10*c*.

In switching device 140 in accordance with the fourteenth embodiment, magnetic flux is generated at the first magnetic yoke 2*b* by flowing a current through the thin-film coil 2*c* of the thin-film electromagnet 10*c*, and thence, the swinger 3*a* is attracted to the first magnetic yoke 2*b*. Thus, the first electrical contact 4 and the second electrical contact 5 make contact with each other, thereby a switch being turned on.

As magnetic substance of which the swinger 3*a* is composed, magnetic substance which is likely to produce residual magnetization may be selected, similarly to the seventh embodiment. The swinger 3*a* composed of magnetic substance which readily produces residual magnetization is magnetized in a left-right direction in FIG. 16A such that its left side has N-polarity and its right side has S-polarity, for instance.

The first thin-film electromagnet 10*c* is caused to operate such that the first magnetic yoke 2*b* is magnetized at its surface to N- or S-polarity.

Thus, if the first magnetic yoke 2*b* is magnetized at a surface thereof into N-polarity, attractive force is generated between the first magnetic yoke 2*b* of the first thin-film electromagnet 10*c* and a free end of the swinger 3*a*. As a result, the swinger 3*a* is attracted at its free end to the first magnetic yoke 2*b* of the first thin-film electromagnet 10*c*, and thus, the first electrical contact 4 and the second electrical contact 5 make contact with each other.

Even if a coil current running through the thin-film coil 2*c* is now interrupted, attractive force is kept generated due to the residual magnetization of the swinger 3*a* between the pole of the first magnetic yoke 2*b* of the first thin-film electromagnet 10*c* and a free end of the swinger 3*a*, and thus, the swinger 3*a* is kept attracted to the first magnetic yoke 2*b*, ensuring on-condition is kept between the second electrical contact 5 and the first electrical contact 4.

If the first magnetic yoke 2*b* is magnetized at a surface thereof into S-polarity, repulsive force is generated between the first magnetic yoke 2*b* of the first thin-film electromagnet 10*c* and the swinger 3*a*. As a result, the swinger 3*a* is separated from the first magnetic yoke 2*b*, and thus, the first and second electrical contacts 4 and 5 are separated from each other.

Fifteenth Embodiment

Figure 17A:
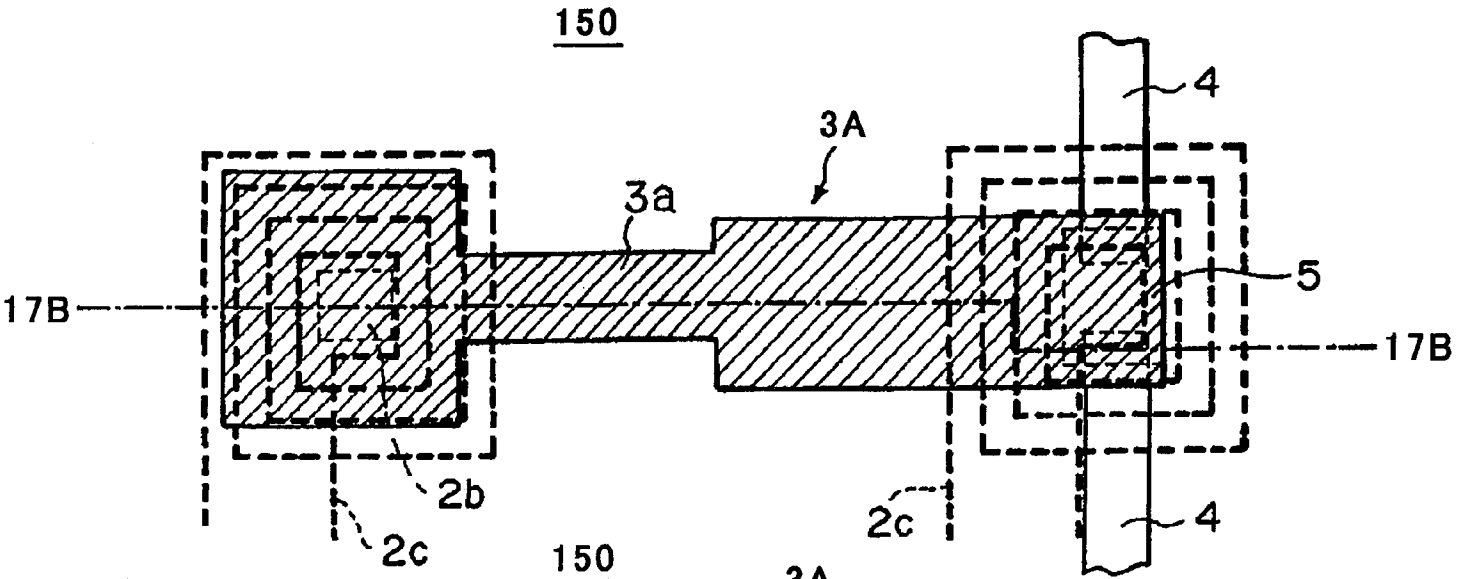
FIG. 17A is a plan view of a switching device in accordance with the fifteenth embodiment of the present invention.
Figure 17B:
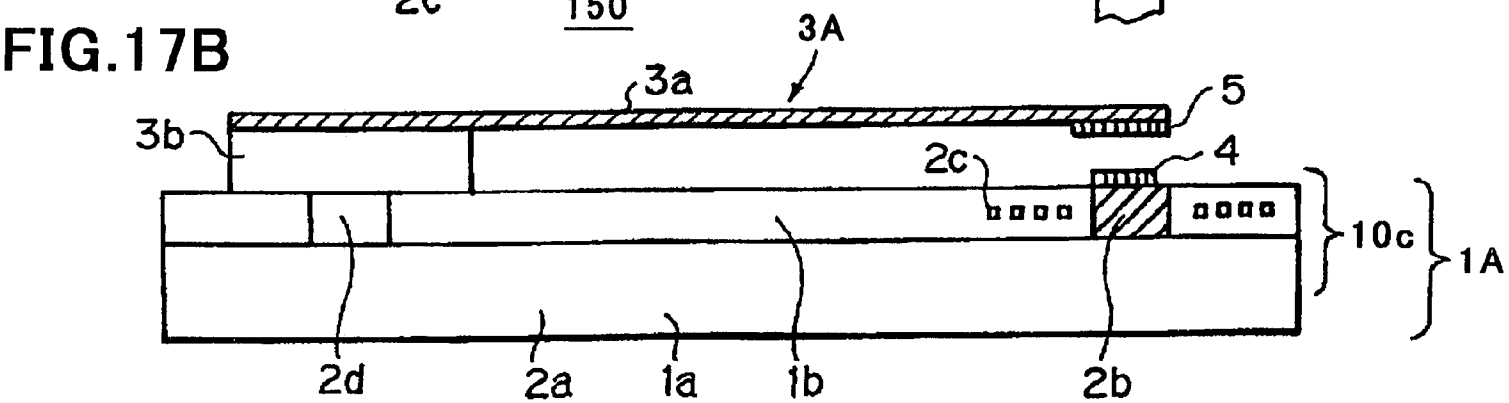
FIG. 17B is a cross-sectional view taken along the line 17B—17B in FIG. 17A.
Figure 18A:
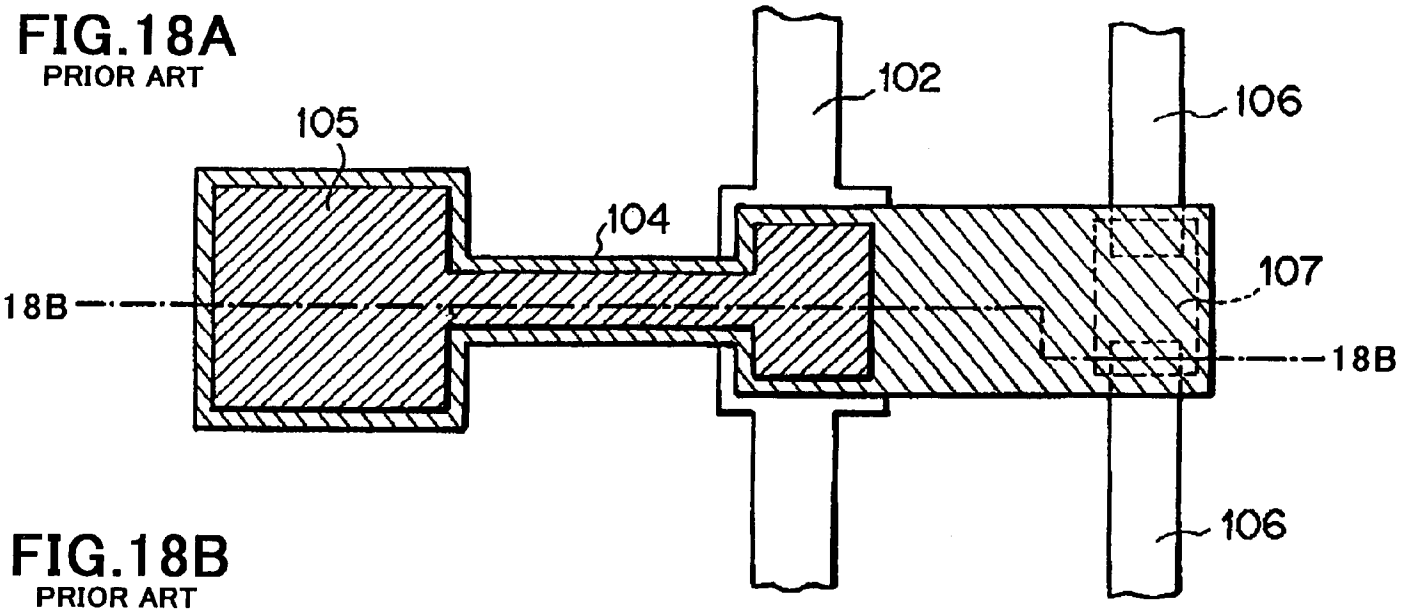
FIG.18A PRIOR ART
FIG. 18A is a plan view of a conventional MEMS switching device.
Figure 18B:
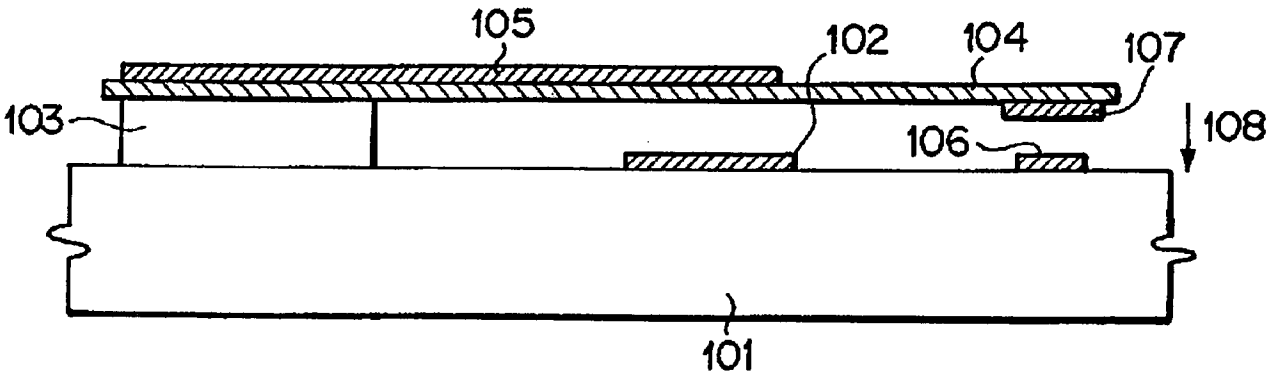
FIG.18B PRIOR ART
FIG. 18B is a cross-sectional view taken along the line 18B—18B in FIG. 18A.
Figure 19:
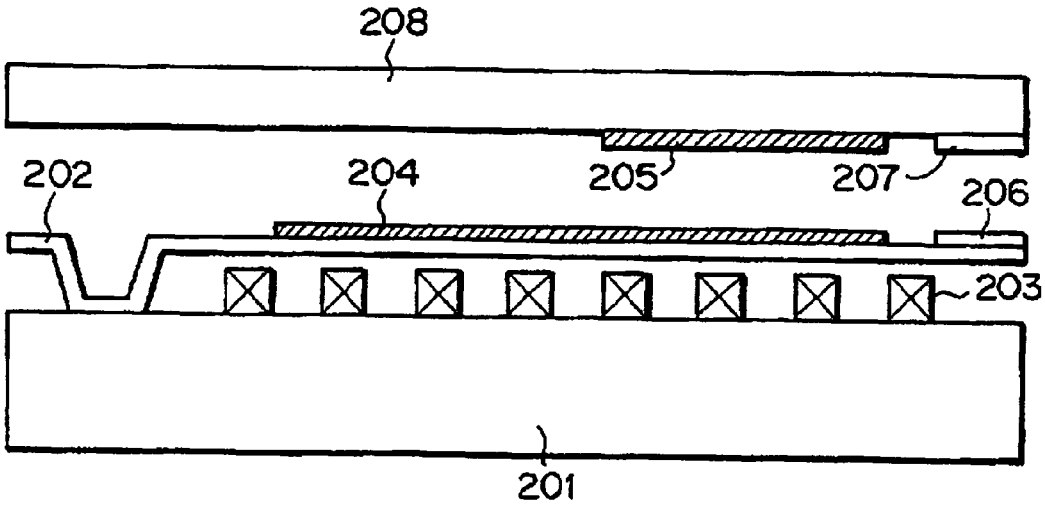
FIG.19 PRIOR ART
FIG. 19 is a cross-sectional view of another conventional MEMS switching device.
Figure 20:
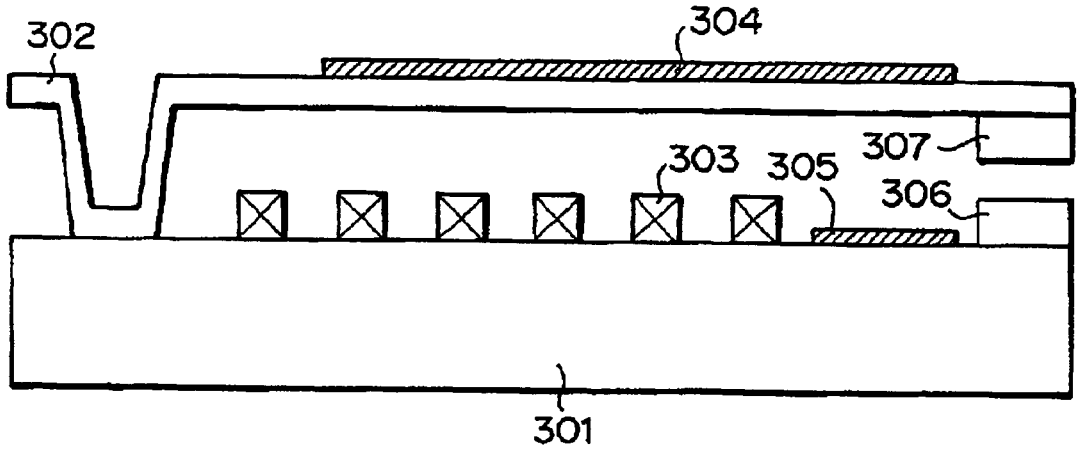
FIG.20 PRIOR ART
FIG. 20 is a cross-sectional view of still another conventional MEMS switching device.
Figure 21:
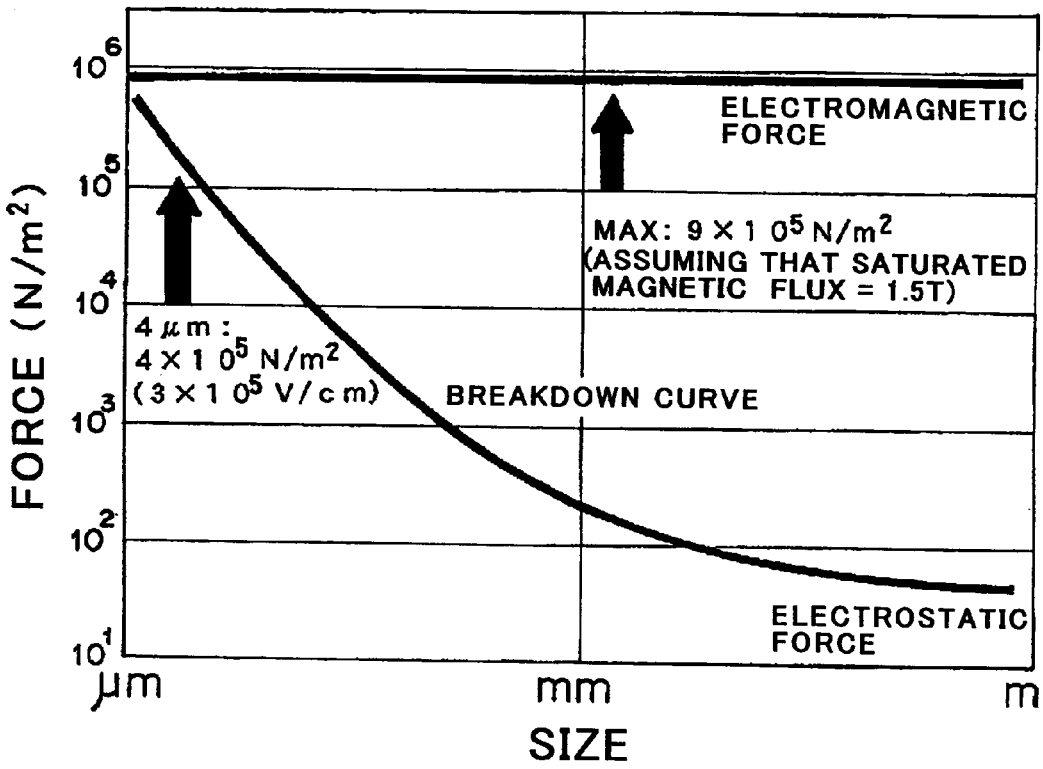
FIG. 21 is a graph showing comparison between electromagnetic force and electrostatic force.

FIGS. 17A and 17B illustrate a switching device 150 in accordance with the fifteenth embodiment of the present invention. FIG. 17A is an upper plan view of the switching device 150, and FIG. 17B is a cross-sectional view taken along the line 17B—17B in FIG. 17A.

Whereas the thin-film electromagnet 10*c* in the switching device 140 in accordance with the fourteenth embodiment, illustrated in FIGS. 16A and 16B, is designed to have the same structure as that of the thin-film electromagnet 20 in accordance with the second embodiment, illustrated in FIGS. 3A and 3B, the thin-film electromagnet 10*c* in the switching device 150 in accordance with the fifteenth embodiment is designed to have the same structure as that of the thin-film electromagnet 40 in accordance with the fourth embodiment, illustrated in FIGS. 5A and 5B. Except the above-mentioned difference, the switching device 150 in accordance with the fifteenth embodiment has same structure as that of the switching device 140 in accordance with the fourteenth embodiment, illustrated in FIGS. 16A and 16B.

The switching device 150 in accordance with the fifteenth embodiment operates in the same way as the switching device 140 in accordance with the fourteenth embodiment, illustrated in FIGS. 16A and 16B, and provides the same advantages as those provided by the switching device 140.

Though the thin-film electromagnet 10*c* in the fourteenth embodiment includes the thin-film electromagnet 20 in accordance with the second embodiment, illustrated in FIGS. 3A and 3B, and the thin-film electromagnet 10*c* in the fifteenth embodiment includes the thin-film electromagnet 40 in accordance with the fourth embodiment, illustrated in FIGS. 5A and 5B, there may be used the thin-film electromagnet 10 in accordance with the first embodiment, illustrated in FIGS. 1A and 1B, the thin-film electromagnet 30 in accordance with the third embodiment, illustrated in FIGS. 4A and 4B, the thin-film electromagnet 50 in accordance with the fifth embodiment, illustrated in FIGS. 6A and 6B or the thin-film electromagnet 60 in accordance with the sixth embodiment, illustrated in FIGS. 7A and 7B.

As having been explained in accordance with the present invention, it is possible to manufacture a thin-film electromagnet which can readily magnetize a magnetic yoke. Hence, it is possible to have a MEMS switch device which can be readily fabricated and which is suitable to an optical switch or a relay switch which can provide wide-angle spatial operation under great forces, due to attractive and repulsive forces between poles, and further to a semiconductor laser irradiating beams having a variable wavelength, or an optical filter.

The invention claimed is:

1. A thin-film electromagnet comprising:

a magnetic yoke and a thin-film coil, characterized in that said magnetic yoke is comprised of a first magnetic yoke and a second magnetic yoke making contact with said first magnetic yoke, said first magnetic yoke is located at a center of a winding of which said thin-film coil is comprised, and said second magnetic yoke is arranged above or below said thin-film coil such that said second magnetic yoke faces said thin-film coil, and overlaps at least a part of said thin-film coil, wherein said thin-film electromagnet has magnetic poles at a surface of said first magnetic yoke which surface is opposite to a surface at which said first and second magnetic yokes make contact with each other, and further at an outer surface of said second magnetic yoke.

2. The thin-film electromagnet as defined in claim 1, wherein said magnetic pole generated at said surface of said first magnetic yoke is out of a center of said winding of which said thin-film coil is comprised.

3. A thin-film electromagnet comprising:

a magnetic yoke and a thin-film coil, characterized in that said magnetic yoke is comprised of a first magnetic yoke and a second magnetic yoke making contact with said first magnetic yoke, said first magnetic yoke is located at a center of a winding of which said thin-film coil is comprised, and said second magnetic yoke is arranged above or below said thin-film coil such that said second magnetic yoke faces said thin-film coil, and overlaps at least a part of said thin-film coil; and an insulating layer formed on said first or second magnetic yoke, wherein said thin-film coil is formed on said insulating layer.

4. A thin-film electromagnet comprising:

a magnetic yoke and a thin-film coil, characterized in that said magnetic yoke is comprised of a first magnetic yoke and a second magnetic yoke making contact with said first magnetic yoke, said first magnetic yoke is located at a center of a winding of which said thin-film coil is comprised, and said second magnetic yoke is arranged above or below said thin-film coil such that said second magnetic yoke faces said thin-film coil, and overlaps at least a part of said thin-film coil; and a protection layer covering said first magnetic yoke, said second magnetic yoke and said thin-film coil therewith, wherein said protection layer is planarized at a surface thereof, and said surface of said first magnetic yoke, constituting said magnetic pole, is exposed to a planarized surface of said protection layer.

5. A thin-film electromagnet comprising:

a magnetic yoke and a thin-film coil, characterized in that said magnetic yoke is comprised of a first magnetic yoke and a second magnetic yoke making contact with said first magnetic yoke, said first magnetic yoke is located at a center of a winding of which said thin-film coil is comprised, and said second magnetic yoke is arranged above or below said thin-film coil such that said second magnetic yoke faces said thin-film coil, and overlaps at least a part of said thin-film coil, wherein said first and second magnetic yokes have a thickness in the range of 0.1 micrometer to 200 micrometers both inclusive.

6. The thin-film electromagnet as defined in claim 5, wherein said first and second magnetic yokes have a thickness in the range of 1 micrometer to 50 micrometers both inclusive.

7. A thin-film electromagnet comprising:

a magnetic yoke and a thin-film coil, characterized in that said magnetic yoke is comprised of a first magnetic yoke and a second magnetic yoke making contact with said first magnetic yoke, said first magnetic yoke is located at a center of a winding of which said thin-film coil is comprised, and said second magnetic yoke is arranged above or below said thin-film coil such that said second magnetic yoke faces said thin-film coil, and overlaps at least a part of said thin-film coil, wherein said first magnetic yoke is arranged above said second magnetic yoke, and said first magnetic yoke is comprised of a central portion located at a center of said winding of which said thin-film coil is comprised, a body portion making contact above said central portion with said central portion, and extending in parallel with said second magnetic yoke in a direction in which said second magnetic yoke extends, and projecting portions upwardly projecting at opposite ends of said body portion.

8. A method of fabricating a thin-film electromagnet comprising a magnetic yoke and a thin-film coil, said magnetic yoke being comprised of a first magnetic yoke and a second magnetic yoke making contact with said first magnetic yoke, said first magnetic yoke being located at a center of a winding of which said thin-film coil is comprised, said method comprising:

the first step of forming said second magnetic yoke on a substrate;

the second step of forming an insulating layer on said second magnetic yoke for electrically insulating said second magnetic yoke and said thin-film coil from each other;

the third step of forming said thin-film coil on said insulating layer;

the fourth step of forming an insulating layer covering said thin-film coil therewith;

the fifth step of forming said first magnetic yoke on said second magnetic yoke;

the sixth step of forming a protection film entirely covering a resultant resulted from said fifth step; and the seventh step of planarizing said protection film such that said first magnetic yoke is exposed to a surface of said protection film.

9. A switching device comprising:

a thin-film electromagnet comprising a magnetic yoke and a thin-film coil, characterized in that said magnetic yoke is comprised of a first magnetic yoke and a second magnetic yoke making contact with said first magnetic yoke, said first magnetic yoke is located at a center of a winding of which said thin-film coil is comprised, and said second magnetic yoke is arranged above or below said thin-film coil such that said second magnetic yoke faces said thin-film coil, and overlaps at least a part of said thin-film coil; and a swingable unit comprised of a pillar, and a swinger supported on said pillar for making swing-movement about said pillar, and switching is carried out by turning on and off electromagnetic force generated between said thin-film electromagnet and said swinger.

10. The switching device as set forth in claim 9, wherein said first magnetic yoke faces said swinger.

11. The switching device as set forth in claim 9, wherein said swinger is supported on said pillar with a spring being arranged therebetween.

12. The switching device as set forth in claim 11, wherein said spring is composed of amorphous metal.

13. The switching device as set forth in claim 11, wherein said spring is composed of shape memory metal.

14. The switching device as set forth in claim 9, wherein said swinger has magnetic substance.

15. The switching device as set forth in claim 14, wherein said magnetic substance has remanent magnetism.

16. A switching device comprising:

a first thin-film electromagnet;

a substrate in which said first thin-film electromagnet is buried;

a first electrical contact formed on a surface of said substrate;

a swinger rotatable in a plane vertical to said substrate by virtue of magnetic force generated by said first thin-film electromagnet; and a second electrical contact formed on said swinger such that said second electrical contact makes contact with said first electrical contact when said swinger rotates towards said substrate;

wherein said first thin-film electromagnet is comprised of a thin-film electromagnet comprising a magnetic yoke and a thin-film coil, characterized in that said magnetic yoke is comprised of a first magnetic yoke and a second magnetic yoke making contact with said first magnetic yoke, said first magnetic yoke is located at a center of a winding of which said thin-film coil is comprised, and said second magnetic yoke is arranged above or below said thin-film coil such that said second magnetic yoke faces said thin-film coil, and overlaps at least a part of said thin-film coil.

17. The switching device as set forth in claim 16, wherein said first electrical contact is formed on a surface of said substrate above said first thing-film electromagnet in electrical insulation from said first thin-film electromagnet.

18. The switching device as set forth in claim 16, wherein said first electrical contact is formed on a surface of said substrate away from said first thin-film electromagnet, and said swinger rotates about an intermediate point between said first thin-film electromagnet and said first electrical contact.

19. A switching device comprising:

a first thin-film electromagnet;

a second thin-film electromagnet;

a substrate in which said first and second thin-film electromagnets are buried;

a first electrical contact formed on a surface of said substrate above said first thin-film electromagnet in electrical insulation from said first thin-film electromagnet;

a second electrical contact formed on a surface of said substrate above said second thin-film electromagnet in electrical insulation from said second thin-film electromagnet;

a swinger rotatable in a plane vertical to said substrate about an intermediate point between said first thin-film electromagnet and said second thin-film electromagnet;

a third electrical contact formed on said swinger such that said third electrical contact makes contact with said first electrical contact when said swinger rotates towards said first thin-film electromagnet; and a fourth electrical contact formed on said swinger such that said fourth electrical contact makes contact with said second electrical contact when said swinger rotates towards said second thin-film electromagnet, wherein each of said first and second thin-film electromagnets is comprised of a thin-film electromagnet comprising a magnetic yoke and a thin-film coil, characterized in that said magnetic yoke is comprised of a first magnetic yoke and a second magnetic yoke making contact with said first magnetic yoke, said first magnetic yoke is located at a center of a winding of which said thin-film coil is comprised, and said second magnetic yoke is arranged above or below said thin-film coil such that said second magnetic yoke faces said thin-film coil, and overlaps at least a part of said thin-film coil.

20. The switching device as set forth in claim 16, further comprising connectors formed on opposite ends of said swinger, and extensions extending in a direction in which said swinger extends and attached to said swinger through said connectors, wherein said third and fourth electrical contacts are formed on said extensions.

21. The switching device as set forth in claim 9, wherein said swinger has a light-reflective surface.

22. A switching device comprising:

a first thin-film electromagnet;

a substrate in which said first thin-film electromagnet is buried; and a swinger rotatable in a plane vertical to said substrate by virtue of magnetic force generated by said first thin-film electromagnet, wherein said swinger has a light-reflective surface, and said first thin-film electromagnet is comprised of a thin-film electromagnet comprising a magnetic yoke and a thin-film coil, characterized in that said magnetic yoke is comprised of a first magnetic yoke and a second magnetic yoke making contact with said first magnetic yoke, said first magnetic yoke is located at a center of a winding of which said thin-film coil is comprised, and said second magnetic yoke is arranged above or below said thin-film coil such that said second magnetic yoke faces said thin-film coil, and overlaps at least a part of said thin-film coil.

23. The switching device as set forth in claim 21 wherein said swinger is covered partially or wholly at a surface thereof with gold or silver.

24. The switching device as set forth in claim 9 wherein said swinger has a mirror unit for reflecting light.

25. A switching device comprising:

a first thin-film electromagnet;

a substrate in which said first thin-film electromagnet is buried;

a swinger rotatable in a plane vertical to said substrate by virtue of magnetic force generated by said first thin-film electromagnet, and a mirror unit mounted on said swinger for reflecting light, wherein said first thin-film electromagnet is comprised of a thin-film electromagnet comprising a magnetic yoke and a thin-film coil, characterized in that said magnetic yoke is comprised of a first magnetic yoke and a second magnetic yoke making contact with said first magnetic yoke, said first magnetic yoke is located at a center of a winding of which said thin-film coil is comprised, and said second magnetic yoke is arranged above or below said thin-film coil such that said second magnetic yoke faces said thin-film coil, and overlaps at least a part of said thin-film coil.

26. The switching device as set forth in claim 25, wherein said mirror unit is formed by forming a sacrifice layer on said swinger, forming a metal or insulating film on said sacrifice layer which film will make said mirror unit, patterning said metal or insulating film, and removing said sacrifice layer.

27. The switching device as set forth in claim 16 further comprising a pair of pillars arranged facing each other outside said swinger in a width-wise direction of said swinger, and a pair of springs mounted on said pillars and extending towards said swinger, wherein said swinger is supported at its opposite edges in its width-wise direction by said springs arranged such that a line connecting said springs to each other passes a center of said swinger in its length-wise direction.

28. A switching device comprising:

a thin-film electromagnet comprising a magnetic yoke and a thin-film coil, characterized in that said magnetic yoke is comprised of a first magnetic yoke and a second magnetic yoke making contact with said first magnetic yoke, said first magnetic yoke is located at a center of a winding of which said thin-film coil is comprised, and said second magnetic yoke is arranged above or below said thin-film coil such that said second magnetic yoke faces said thin-film coil, and overlaps at least a part of said thin-film coil; and a swingable unit is comprised of a pillar, and a cantilever supported on said pillar for making swing-movement about said pillar, wherein switching is carried out by turning on and off electromagnetic force generated between said thin-film electromagnet and a free end of said cantilever.

29. A method of fabricating a switching device defined in claim 16, said method comprising:

the first step of forming said second magnetic yoke on a substrate;

the second step of forming an insulating layer on said second magnetic yoke for electrically insulating said second magnetic yoke and said thin-film coil from each other;

the third step of forming said thin-film coil on said insulating layer;

the fourth step of forming an insulating layer covering said thin-film coil therewith;

the fifth step of forming said first magnetic yoke on said second magnetic yoke;

the sixth step of forming a protection film entirely covering a resultant resulted from said fifth step;

the seventh step of planarizing said protection film such that said first magnetic yoke is exposed to a surface of said protection film;

the eighth step of forming an electrical contact on said protection layer;

the ninth step of forming a sacrifice layer on said protection layer, said sacrifice layer having a pattern in which openings are formed in predetermined areas;

the tenth step of filling said openings with a predetermined material to form a pillar by which said swinger is supported;

the eleventh step of forming said swinger on said sacrifice layer; and the twelfth step of removing said sacrifice layer.

30. A thin-film electromagnet comprising:

a magnetic yoke and a thin-film coil, characterized in that said magnetic yoke is comprised of a first magnetic yoke and a second magnetic yoke making contact with said first magnetic yoke, said first magnetic yoke is located at a center of a winding of which said thin-film coil is comprised, and said second magnetic yoke is arranged above or below said thin-film coil such that said second magnetic yoke faces said thin-film coil, and overlaps at least a part of said thin-film coil;

a first insulating layer and a second insulating layer; and a protection film, wherein said first insulating layer is located on said second magnetic yoke for electrically insulating said second magnetic yoke and said thin-film coil from each other, said second insulating layer is located on said thin-film coil for covering said thin-film coil therewith, said protecting film is located entirely on said second yoke and said thin-film coil, and said first magnetic yoke is exposed to a surface of said protection film.

31. The thin-film electromagnet as defined in claim 30, wherein said thin-film coil is located on said second magnetic yoke through said first insulating layer, and said first magnetic yoke is located on said second yoke.

* * * * *